US012098723B2

(12) United States Patent
Kim et al.

(10) Patent No.: US 12,098,723 B2
(45) Date of Patent: Sep. 24, 2024

(54) RETAINER BLOCK BYPASS HOLE VALVE ASSEMBLY ARRANGED IN NON-ORBITING SCROLL OF A COMPRESSOR

(71) Applicant: LG ELECTRONICS INC., Seoul (KR)

(72) Inventors: Jeonghun Kim, Seoul (KR); Changeol Jo, Seoul (KR); Nara Han, Seoul (KR); Juhwan Yun, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/367,576

(22) Filed: Sep. 13, 2023

(65) Prior Publication Data

US 2024/0102469 A1 Mar. 28, 2024

(30) Foreign Application Priority Data

Sep. 27, 2022 (KR) ..... 10-2022-0122675

(51) Int. Cl.
*F04C 28/26* (2006.01)
*F04C 18/02* (2006.01)
(Continued)

(52) U.S. Cl.
CPC ..... *F04C 28/26* (2013.01); *F04C 18/0215* (2013.01); *F04C 18/0246* (2013.01);
(Continued)

(58) Field of Classification Search
CPC .... F04C 28/26; F04C 18/0215; F04C 29/128; F04C 23/008; F04C 2240/805;
(Continued)

(56) References Cited

U.S. PATENT DOCUMENTS

2010/0303659 A1 12/2010 Stover et al.
2011/0206548 A1 8/2011 Doepker
(Continued)

FOREIGN PATENT DOCUMENTS

CN 204511881 7/2015
CN 111472977 7/2020
(Continued)

OTHER PUBLICATIONS

English Machine Translation of CN111472977A via Espacenet (Year: 2020).*
(Continued)

*Primary Examiner* — Bryan M Lettman
*Assistant Examiner* — Paul W Thiede
(74) *Attorney, Agent, or Firm* — KED & ASSOCIATES

(57) ABSTRACT

A scroll compressor is provided that may include a block insertion groove to accommodate a discharge port and at least one bypass hole disposed in a rear surface of a non-orbiting end plate of a non-orbiting scroll, and a retainer block including at least one bypass valve to open or close the bypass hole inserted into the block insertion groove. The bypass hole may include a first bypass hole and a second bypass hole. The bypass valve may include a first bypass valve to open or close the first bypass hole and a second bypass valve to open or close the second bypass hole, and may be disposed between the block insertion groove and the retainer block facing the block insertion groove. Accordingly, the first and second bypass valves are not fastened to the non-orbiting end plate, which may allow the non-orbiting end plate to be made thin.

20 Claims, 19 Drawing Sheets

(51) Int. Cl.
*F04C 23/00* (2006.01)
*F04C 27/00* (2006.01)
*F04C 29/12* (2006.01)

(52) U.S. Cl.
CPC ..... *F04C 27/005* (2013.01); *F04C 29/128* (2013.01); *F04C 23/008* (2013.01); *F04C 2240/805* (2013.01); *F04C 2270/185* (2013.01)

(58) Field of Classification Search
CPC ..... F04C 2270/185; F04C 18/0246; F04C 27/005; F04C 27/007
See application file for complete search history.

(56) References Cited

U.S. PATENT DOCUMENTS

| | | | | |
|---|---|---|---|---|
| 2015/0192121 | A1 | 7/2015 | Sung et al. | |
| 2015/0345493 | A1 | 12/2015 | Lochner et al. | |
| 2018/0038370 | A1 | 2/2018 | Doepker et al. | |
| 2018/0216618 | A1* | 8/2018 | Jeong | F04C 28/26 |
| 2022/0136501 | A1* | 5/2022 | Yun | F04C 18/0253 418/55.2 |
| 2023/0400022 | A1* | 12/2023 | Jo | F04C 29/124 |

FOREIGN PATENT DOCUMENTS

| | | | |
|---|---|---|---|
| CN | 215333410 U | * | 12/2021 |
| KR | 10-2014-0114212 | | 9/2014 |
| KR | 10-2017-0007374 | | 1/2017 |

OTHER PUBLICATIONS

English Machine Translation of CN215333410U translated via Espacenet (Year: 2021).*
European Search Report dated Feb. 20, 2024, issued in Application No. 23199967.3.
Korean Office Action dated Jan. 30, 2024, issued in Application No. 10-2022-0122675.

* cited by examiner

RETAINER BLOCK BYPASS HOLE VALVE ASSEMBLY ARRANGED IN NON-ORBITING SCROLL OF A COMPRESSOR

CROSS-REFERENCE TO RELATED APPLICATION(S)

Pursuant to 35 U.S.C. § 119(a), this application claims the benefit of the earlier filing date and the right of priority to Korean Patent Application No. 10-2022-0122675, filed in Korea on Sep. 27, 2022, the contents of which are incorporated by reference herein in their entirety.

BACKGROUND

1. Field

A scroll compressor is disclosed herein.

2. Background

A scroll compressor is configured such that an orbiting scroll and a non-orbiting scroll are engaged with each other, and a pair of compression chambers is disposed between the orbiting scroll and the non-orbiting scroll while the orbiting scroll performs an orbiting motion with respect to the non-orbiting scroll. The compression chamber includes a suction pressure chamber defined at an outer side, an intermediate pressure chamber continuously defined toward a central portion from the suction pressure chamber while gradually decreasing in volume, and a discharge pressure chamber connected to a center of the intermediate pressure chamber. Typically, the suction pressure chamber communicates with a refrigerant suction pipe that extends through a side surface of a non-orbiting scroll, the intermediate pressure chamber is sealed and connected in multiple stages, and the discharge pressure chamber communicates with a refrigerant discharge pipe that extends through a center of an end plate of the non-orbiting scroll.

The scroll compressor is configured so that the compression chamber continuously moves, which may cause overcompression during operation. Accordingly, in the related art scroll compressor, a bypass hole is disposed around a discharge port, that is, at an upstream side of the discharge port to discharge over compressed refrigerant in advance. A bypass valve is disposed in the bypass hole to open and close the bypass hole according to pressure in the compression chamber. A plate valve or a reed valve is mainly applied as the bypass valve.

U.S. Patent Publication No. US2018/0038370 (hereinafter "Patent Document 1"), which is hereby incorporated by reference, discloses a scroll compressor to which a bypass valve configured as a plate valve is applied. Patent Document 1 discloses that a single bypass valve in an annular shape opens and closes a plurality of bypass holes, but this increases the number of components as the bypass valve is supported by an elastic member. In addition, as the bypass valve operates in a separated state, it is difficult to modularize the bypass valve, which may increase the number of assembly processes of the compressor. As a length of the bypass hole increases, not only overcompression due to discharge delay occurs, but also a dead volume increases, which may decrease efficiency.

Korean Patent Publication No. 10-2014-0114212 (hereinafter "Patent Document 2") and U.S. Patent Publication No. US2015/0345493 (hereinafter "Patent Document 3"), which are hereby incorporated by reference, each discloses a scroll compressor to which a bypass valve configured as a reed valve is applied. In Patent Document 2 and Patent Document 3, the bypass valve is fixed to a non-orbiting scroll using a rivet or pin. An end plate of the non-orbiting scroll should be as thick as a rivet depth or pin depth, which causes an increase in the length of the bypass hole. As a result, as in Patent Document 1, refrigerant discharge through the bypass hole is delayed and thereby the refrigerant is over compressed. In addition, a dead volume increases due to the increased length of the bypass hole, causing efficiency to be degraded.

BRIEF DESCRIPTION OF THE DRAWINGS

Embodiments will be described in detail with reference to the following drawings in which like reference numerals refer to like elements, and wherein.

DETAILED DESCRIPTION

Figure 1:
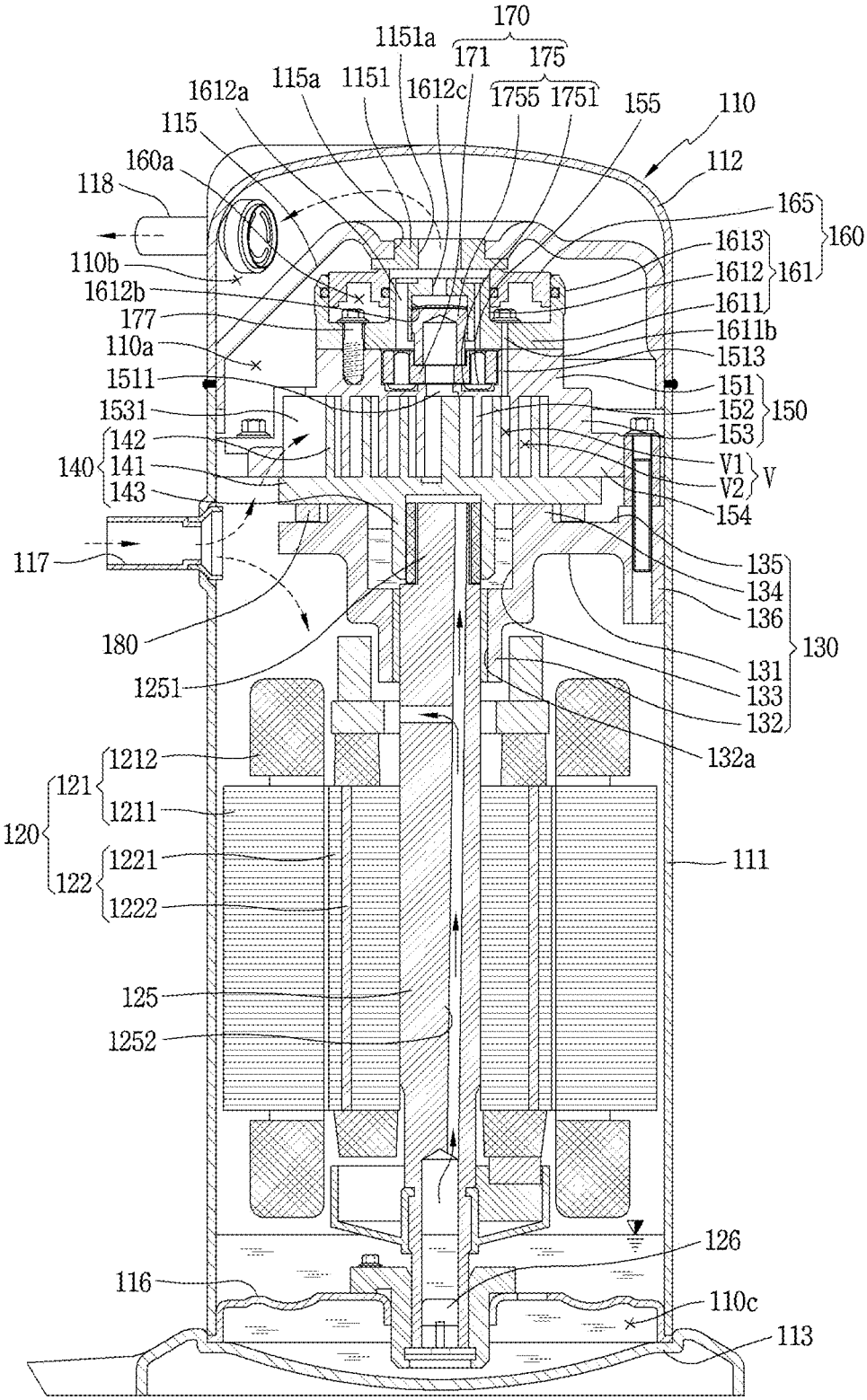
FIG. 1 is a longitudinal cross-sectional view illustrating an inner structure of a capacity-variable scroll compressor in accordance with an embodiment.

Description will now be given of a scroll compressor according to exemplary embodiments disclosed herein, with reference to the accompanying drawings.

Typically, a scroll compressor may be classified as an open type or a hermetic type depending on whether a drive (motor) and a compression part or portion are all installed in an inner space of a casing. The former is a compressor in which the motor configuring the drive is provided separately from the compression portion, and the latter hermetic type is a compressor in which both the motor and the compression portion are disposed inside of the casing. Hereinafter, a hermetic type scroll compressor will be described as an example, but embodiments are not necessarily limited to the hermetic scroll compressor. In other words, the embodiments may be equally applied even to the open type scroll compressor in which the motor and the compression portion are disposed separately from each other.

A scroll compressor is also classified as a low-pressure type compressor or a high-pressure type compressor depending on what type of pressure portion is defined in an inner space of a casing, more specifically, a space that accommodates the motor in a hermetic scroll compressor. In the former, the space defines a low-pressure part or portion and a refrigerant suction pipe communicates with the space. On the other hand, in the latter, the space defines a high-pressure part or portion and the refrigerant suction pipe is directly connected to the compression portion through the casing. Hereinafter, a low-pressure type scroll compressor according to an embodiment will be described as an example. However, the embodiments are not limited to the low-pressure type scroll compressor.

In addition, scroll compressors may be classified into a vertical scroll compressor in which a rotary shaft is disposed perpendicular to the ground and a horizontal (lateral) scroll compressor in which the rotary shaft is disposed parallel to the ground. For example, in the vertical scroll compressor, an upper side may be defined as an opposite side to the ground and a lower side may be defined as a side facing the ground. Hereinafter, the vertical scroll compressor will be described as an example. However, the embodiments may also be equally applied to the horizontal scroll compressor. Hereinafter, it will be understood that an axial direction is an axial direction of the rotary shaft, a radial direction is a radial direction of the rotary shaft, the axial direction is an upward and downward direction, the radial direction is a leftward and rightward direction, and an inner circumferential surface is an upper surface, respectively.

In addition, scroll compressors may be mainly divided into a tip seal type and a back pressure type depending on a method of sealing between compression chambers. The back pressure type may be divided into an orbiting back pressure type of pressing an orbiting scroll toward a non-orbiting scroll, and a non-orbiting back pressure type of pressing the non-orbiting scroll toward the orbiting scroll. Hereinafter, a scroll compressor to which a non-orbiting back pressure type is applied will be described as an example. However, the embodiments may also be applied to the tip seal type as well as the orbiting back pressure type.

Referring to FIG. 1, a scroll compressor according to an embodiment may include a drive motor 120 constituting a motor disposed in a lower half portion of a casing 110, and a main frame 130, an orbiting scroll 140, a non-orbiting scroll 150, a back pressure chamber assembly 160, and a valve assembly 170 that constitute a compression portion disposed above the drive motor 120. The motor is coupled to one (first) end of a rotary shaft 125, and the compression portion is coupled to another (second) end of the rotary shaft 125. Accordingly, the compression portion may be connected to the motor by the rotary shaft 125 to be operated by a rotational force of the motor.

Referring to FIG. 1, the casing 110 according to an embodiment may include a cylindrical shell 111, an upper cap 112, and a lower cap 113. The cylindrical shell 111 may have a cylindrical shape with upper and lower ends open, and the drive motor 120 and the main frame 130 may be fitted on an inner circumferential surface of the cylindrical shell 111. A terminal bracket (not illustrated) may be coupled to an upper half portion of the cylindrical shell 111. A terminal (not illustrated) that transmits external power to the drive motor 120 may be coupled through the terminal bracket. In addition, a refrigerant suction pipe 117 discussed hereinafter may be coupled to the upper portion of the cylindrical shell 111, for example, above the drive motor 120.

The upper cap 112 may be coupled to cover the open upper end of the cylindrical shell 111. The lower cap 113 is coupled to cover the lower opening of the cylindrical shell 111. A rim of a high/low pressure separation plate 115 discussed hereinafter is inserted between the cylindrical shell 111 and the upper cap 112 to be, for example, welded on the cylindrical shell 111 and the upper cap 112. A rim of a support bracket 116 discussed hereinafter may be inserted between the cylindrical shell 111 and the lower cap 113 to be welded, for example, on the cylindrical shell 111 and the lower cap 113. Accordingly, the inner space of the casing 110 may be sealed.

A rim of the high/low pressure separation plate 115 may be, for example, welded on the casing 110 as described above. A central portion of the high/low pressure separation plate 115 may be bent and protrude toward an upper surface of the upper cap 112 so as to be disposed above the back pressure chamber assembly 160 discussed hereinafter. A refrigerant suction pipe 117 may communicate with a space below the high/low pressure separation plate 115, and a refrigerant discharge pipe 118 may communicate with a space above the high/low pressure separation plate 115.

Accordingly, the low-pressure portion 110*a* constituting a suction space may disposed below the high/low pressure separation plate 115, and a high-pressure portion 110*b* constituting a discharge space is disposed above the high/low pressure separation plate 115.

In addition, a through hole 115*a* is disposed through a center of the high/low pressure separation plate 115. A sealing plate 1151 from which a floating plate 165 discussed hereinafter is detachable is inserted into the through hole 115*a*. The low-pressure portion 110*a* and the high-pressure portion 110*b* may be blocked from each other by attachment/detachment of the floating plate 165 and the sealing plate 1151 or may communicate with each other through a high/low pressure communication hole 1151*a* of the sealing plate 1151.

In addition, the lower cap 113 may define an oil storage space 110*c* together with the lower portion of the cylindrical shell 111 constituting the low-pressure portion 110*a*. In other words, the oil storage space 110*c* is defined in the lower portion of the low-pressure portion 110*a*. The oil storage space 110*c* thus defines a portion of the low-pressure portion 110*a*.

Referring to FIG. 1, the drive motor 120 according to an embodiment may be disposed in a lower half portion of the low-pressure portion 110*a* and may include a stator 121 and a rotor 122. The stator 121 may be, for example, shrink-fitted to an inner wall surface of the casing 111, and the rotor 122 may be rotatably provided inside of the stator 121.

The stator 121 may include a stator core 1211 and a stator coil 1212. The stator core 1211 may have a cylindrical shape and be, for example, shrink-fitted onto an inner circumferential surface of the cylindrical shell 111. The stator coil 1212 may be wound around the stator core 1211 and may be electrically connected to an external power source through a terminal (not illustrated) that is coupled through the casing 110.

The rotor 122 includes a rotor core 1221 and permanent magnets 1222. The rotor core 1221 may have a cylindrical shape, and be rotatably inserted into the stator core 1211 with a preset or predetermined gap therebetween. The permanent magnets 1222 may be embedded in the rotor core 1222 at preset or predetermined intervals along a circumferential direction.

In addition, the rotary shaft 125 may be press-fitted to a center of the rotor core 1221. An orbiting scroll 140 discussed hereinafter may be eccentrically coupled to an upper end of the rotary shaft 125. Accordingly, the rotational force of the drive motor 120 may be transmitted to the orbiting scroll 140 through the rotary shaft 125.

An eccentric portion 1251 that is eccentrically coupled to the orbiting scroll 140 discussed hereinafter may be disposed on an upper end of the rotary shaft 125. An oil pickup 126 that suctions up oil stored in the lower portion of the casing 110 may be disposed in or at a lower end of the rotary shaft 125. An oil passage 1252 may be disposed through an inside of the rotary shaft 125 in the axial direction.

Referring to FIG. 1, the main frame 130 may be disposed on an upper side of the drive motor 120, and may be, for example, shrink-fitted to or welded on an inner wall surface of the cylindrical shell 111. The main frame 130 may include a main flange portion 131, a main bearing portion 132, an orbiting space portion 133, a scroll support portion 134, an Oldham ring support portion 135, and a frame fixing portion 136.

The main flange portion 131 may have an annular shape and be accommodated in the low-pressure portion 110*a* of the casing 110. An outer diameter of the main flange portion 131 may be smaller than an inner diameter of the cylindrical shell 111 so that an outer circumferential surface of the main flange portion 131 is spaced apart from an inner circumferential surface of the cylindrical shell 111. However, the frame fixing portion 136 discussed hereinafter protrudes from an outer circumferential surface of the main flange portion 131 in the radial direction. An outer circumferential surface of the frame fixing portion 136 may be fixed in close contact with the inner circumferential surface of the casing 110. Accordingly, the frame 130 may be fixedly coupled to the casing 110.

The main bearing portion 132 may protrude downward from a lower surface of a central portion of the main flange portion 131 toward the drive motor 120. A bearing hole 132*a* having a cylindrical shape may penetrate through the main bearing portion 132 in the axial direction. The rotary shaft 125 may be inserted into an inner circumferential surface of the bearing hole 132*a* and supported in the radial direction.

The orbiting space portion 133 may be recessed from the center portion of the main flange portion 131 toward the main bearing portion 132 to have a predetermined depth and outer diameter. The outer diameter of the orbiting space portion 133 may be larger than an outer diameter of a rotary shaft coupling portion 143 that is disposed on the orbiting scroll 140 discussed hereinafter. Accordingly, the rotary shaft coupling portion 143 may be pivotally accommodated in the orbiting space portion 133.

The scroll support portion 134 may have an annular shape and be disposed on an upper surface of the main flange portion 131 along a circumference of the orbiting space portion 133. Accordingly, the scroll support portion 134 may support the lower surface of an orbiting end plate 141 discussed hereinafter in the axial direction.

The Oldham ring support portion 135 may have an annular shape and be disposed on an upper surface of the main flange portion 131 along an outer circumferential surface of the scroll support portion 134. Accordingly, an Oldham ring 139 may be pivotably inserted into the Oldham ring supporting portion 135.

The frame fixing portion 136 may extend radially from an outer circumference of the Oldham ring support portion 135. The frame fixing portion 136 may extend in an annular shape or extend to form a plurality of protrusions spaced apart from one another by preset or predetermined distances. This embodiment illustrates an example in which the frame fixing portion 136 has a plurality of protrusions along the circumferential direction.

Referring to FIG. 1, the orbiting scroll 140 according to an embodiment may be coupled to the rotary shaft 125 to be disposed between the main frame 130 and the non-orbiting scroll 150. An Oldham ring 139, which is an anti-rotation mechanism, may be disposed between the main frame 130 and the orbiting scroll 140. Accordingly, the orbiting scroll 140 performs an orbiting motion relative to the non-orbiting scroll 150 while its rotational motion is restricted.

The orbiting scroll 140 may include an orbiting end plate 141, an orbiting wrap 142, and a rotary shaft coupling portion 143. The orbiting end plate 141 may have an approximately disk shape. An outer diameter of the orbiting end plate 141 may be mounted on the scroll support portion 134 of the main frame 130 to be supported in the axial direction. Accordingly, the orbiting end plate 141 and the scroll support portion 134 facing it defines an axial bearing surface (no reference numeral given).

The orbiting wrap 142 may be disposed in a spiral shape by protruding from an upper surface of the orbiting end plate 141 facing the non-orbiting scroll 150 to a preset or predetermined height. The orbiting wrap 142 is disposed to correspond to the non-orbiting wrap 152 to perform an orbiting motion by being engaged with a non-orbiting wrap 152 of the non-orbiting scroll 150 discussed hereinafter. The orbiting wrap 142 defines compression chambers V together with the non-orbiting wrap 152.

The compression chambers V may include a first compression chamber V1 and a second compression chamber V2 based on the orbiting wrap 142. Each of the first compression chamber V1 and the second compression chamber V2 may include a suction pressure chamber (not illustrated), an intermediate pressure chamber (not illustrated), and a discharge pressure chamber (not illustrated) that are continuously formed. Hereinafter, description will be given under the assumption that a compression chamber defined between an outer surface of the orbiting wrap 142 and an inner surface of the non-orbiting wrap 152 facing the same is defined as the first compression chamber V1, and a compression chamber defined between an inner surface of the orbiting wrap 142 and an outer surface of the non-orbiting wrap 152 facing the same is defined as the second compression chamber V2.

A rotary shaft coupling portion 143 may protrude from a lower surface of the orbiting end plate 141 toward the main frame 130. The rotary shaft coupling portion 143 may have a cylindrical shape, so that an orbiting bearing (not illustrated) configured as a bush bearing may be press-fitted thereinto.

Figure 2:
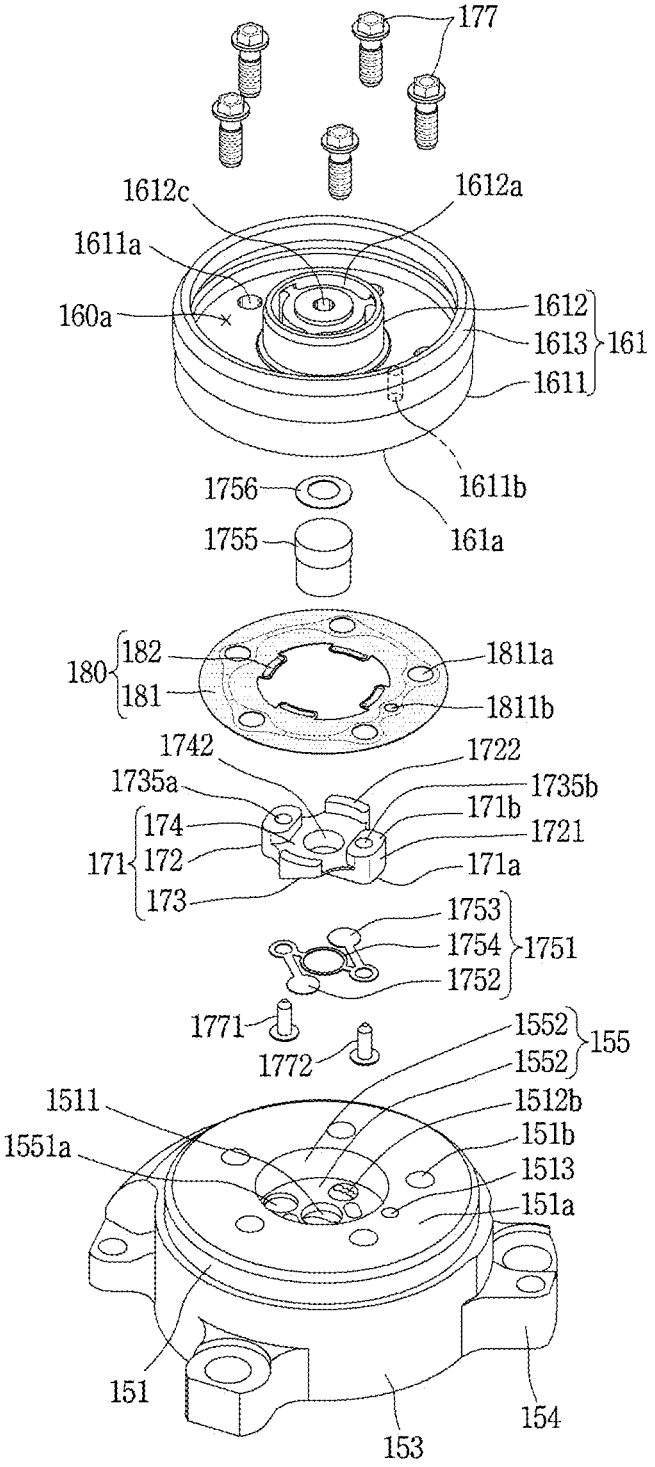
FIG. 2 is an exploded perspective view illustrating a non-orbiting scroll and a back pressure plate in FIG. 1.

Referring to FIGS. 1 and 2, the non-orbiting scroll 150 according to an embodiment may be disposed on an upper portion of the main frame 130 with the orbiting scroll 140 interposed therebetween. The non-orbiting scroll 150 may be fixedly coupled to the main frame 130 or may be coupled to the main frame 130 to be movable up and down. This embodiment illustrates an example in which the non-orbiting scroll 150 is coupled to the main frame 130 to be movable relative to the main frame 130 in the axial direction.

The non-orbiting scroll 150 according to this embodiment may include a non-orbiting end plate 151, a non-orbiting wrap 152, a non-orbiting side wall portion 153, and a guide protrusion 154. The non-orbiting end plate 151 may have a disk shape and be disposed in a lateral direction in the low-pressure portion 110*a* of the casing 110. A plurality of back pressure fastening grooves 151*b* may be disposed along an edge of the non-orbiting end plate 151. Accordingly, back pressure fastening bolts 177 that pass through back pressure fastening holes 1611*a* of a back pressure plate 161 discussed hereinafter may be fastened to the back pressure fastening grooves 151*b* of the non-orbiting end plate 151, such that the back pressure plate 161 may be fastened to a rear surface (upper surface) 151*a* of the non-orbiting end plate 151.

A discharge port 1511, bypass holes 1512, and a first back pressure hole 1513 may be disposed through a central portion of the non-orbiting end plate 151 in the axial direction. The discharge port 1511 may be disposed at a center of the non-orbiting end plate 151, and the bypass holes 1512 may be disposed to communicate with a compression chamber having a lower pressure than that of another compression chamber communicating with the discharge port 1511. The first back pressure hole 1513 may be disposed to communicate with a compression chamber having a lower pressure than that the compression chamber communicating with the bypass holes 1512.

The discharge port 1511 may be located at a position at which a discharge pressure chamber (no reference numeral given) of the first compression chamber V1 and a discharge pressure chamber (no reference numeral given) of the second compression chamber V2 communicate with each other. Accordingly, refrigerant compressed in the first compression chamber V1 and refrigerant compressed in the second compression chamber V2 may be combined in the discharge pressure chamber and discharged to the high-pressure portion 110*b* through the discharge port 1511.

The bypass holes 1512 may include first bypass hole 1512*a* and second bypass hole 1512*b*. Each of the first bypass hole 1512*a* and the second bypass hole 1512*b* may be provided as a single hole or may be provided as a plurality. This embodiment illustrates an example in which each of the first bypass hole 1512*a* and the second bypass hole 1512*b* is provided as a plurality. Accordingly, the bypass holes may be smaller than a wrap thickness of the orbiting wrap 142 and also an entire area of the bypass holes 1512 may be enlarged.

The first bypass hole 1512*a* communicates with the first compression chamber V1 and the second bypass hole 1512*b* communicates with the second compression chamber V2. The first bypass hole 1512*a* and the second bypass hole 1512*b* may be disposed at both sides of the discharge port 1511 in the circumferential direction with the discharge port 1511 located at the center, in other words, disposed at a suction side rather than the discharge port 1511. Accordingly, when refrigerant is over compressed in each of the compression chambers V1 and V2, the refrigerant may be bypassed in advance before reaching the discharge port 1511, thereby suppressing or preventing overcompression.

Both the first bypass hole 1512*a* and the second bypass hole 1512*b* may be accommodated in a block insertion groove 155 discussed hereinafter. In other words, the block insertion groove 155 may be recessed by a preset or predetermined depth into the rear surface 151*a* of the non-orbiting end plate 151, and the first bypass hole 1512*a* and the second bypass hole 1512*b* may be disposed inside of the block insertion groove 155 together with the discharge port 1511. Accordingly, each length L2 of the first bypass hole 1512*a* and the second bypass hole 1512*b* may be reduced by a value that is obtained by subtracting a depth D1 of the block insertion groove 155 from a thickness H1 of the non-orbiting end plate 151, which may result in decreasing dead volumes in the first bypass hole 1512*a* and the second bypass hole 1512*b*. The block insertion groove 155 will be described hereinafter together with the retainer block 171.

The first back pressure hole 1513 may extend through the non-orbiting end plate 151 in the axial direction, so as to communicate with a compression chamber V having an intermediate pressure between a suction pressure and a discharge pressure. The first back pressure hole 1513 may be provided as one to communicate with any one of the first compression chamber V1 and the second compression chamber V2, or may be provided as a plurality to communicate with the first and second compression chambers V1 and V2, respectively. The first back pressure hole 1513 may be disposed outside of the block insertion groove 155 described above.

The non-orbiting wrap 152 may extend axially from a lower surface of the non-orbiting end plate 151. The non-orbiting wrap 152 may have a spiral shape inside of the non-orbiting side wall portion 153 to correspond to the orbiting wrap 142 so as to be engaged with the orbiting wrap 142.

The non-orbiting side wall portion 153 may extend in an annular shape from a rim of a lower surface of the non-orbiting end plate 151 in the axial direction to surround the non-orbiting wrap 152. A suction port 1531 may be disposed through one side of an outer circumferential surface of the non-orbiting side wall portion 153 in the radial direction. Accordingly, each of the first compression chamber V1 and the second compression chamber V2 compresses suctioned refrigerant as its volume decreases from an outer side to a center.

The guide protrusion 154 may extend radially from an outer circumferential surface of a lower side of the non-orbiting side wall portion 153. The guide protrusion 154 may have a single annular shape or may be provided as a plurality disposed at preset or predetermined distances in the circumferential direction. This embodiment will be mainly described based on an example in which the plurality of guide protrusions 154 is disposed at preset or predetermined distances along the circumferential direction.

Referring to FIG. 1, the back pressure chamber assembly 160 according to an embodiment may be disposed at an upper side of the non-orbiting scroll 150. Accordingly, back pressure of a back pressure chamber 160*a* (more specifically, a force by which the back pressure acts on the back pressure chamber) is applied to the non-orbiting scroll 150. In other words, the non-orbiting scroll 150 is pressed toward the orbiting scroll 140 by the back pressure to seal the compression chambers V1 and V2.

The back pressure chamber assembly 160 may include a back pressure plate 161 and a floating plate 165. The back pressure plate 161 may be coupled to an upper surface of the non-orbiting end plate 151. A floating plate 165 is slidably coupled to the back pressure plate 161 to define the back pressure chamber 160*a* together with the back pressure plate 161.

The back pressure plate 161 may include a fixed plate portion 1611, a first annular wall portion 1612, and a second annular wall portion 1613. The fixed plate portion 1611 have the form of an annular plate with a hollow center. A plurality of back pressure fastening holes 1611*a* may be disposed along an edge of the fixed plate portion 1611. Accordingly, the fixed plate portion 1611 may be fastened to the non-orbiting scroll 150 by the back pressure fastening bolts 177 inserted through the back pressure fastening holes 1611*a*.

A plate-side back pressure hole (hereinafter, referred to as a second back pressure hole) 1611*b* may be disposed through the fixed plate portion 1611 in the axial direction. The second back pressure hole 1611*a* communicates with the compression chamber V through the first back pressure hole 1513. Accordingly, the compression chamber V and the back pressure chamber 160*a* communicate with each other through the second back pressure hole 1611*a* as well as the first back pressure hole 1513.

The first annular wall portion 1612 and the second annular wall portion 1613 may be disposed on an upper surface of the fixed plate portion 1611 to surround inner and outer circumferential surfaces of the fixed plate portion 1611. Accordingly, the back pressure chamber 160*a* having the annular shape is defined by an outer circumferential surface of the first annular wall portion 1612, an inner circumferential surface of the second annular wall portion 1613, the upper surface of the fixed plate portion 1611, and a lower surface of the floating plate 165.

The first annular wall portion 1612 may include an intermediate discharge port 1612*a* that communicates with the discharge port 1511 of the non-orbiting scroll 150. A valve guide groove 1612*b* into which a discharge valve 1755 is slidably inserted may be disposed at an inner side of the intermediate discharge port 1612*a*. A backflow prevention hole 1612*c* may be disposed in or at a center of the valve guide groove 1612*b*. Accordingly, the discharge valve 1755 may be selectively opened and closed between the discharge port 1511 and the intermediate discharge port 1612*a* to suppress or prevent discharged refrigerant from flowing back into the compression chambers V1 and V2.

The floating plate 165 may have an annular shape. The floating plate 165 may be made of a lighter material than the back pressure plate 161. Accordingly, the floating plate 165 may be detachably coupled to a lower surface of the high/low pressure separation plate 115 while moving in the axial direction with respect to the back pressure plate 161 depending on pressure of the back pressure chamber 160*a*. For example, when the floating plate 165 is brought into contact with the high/low pressure separation plate 115, the floating plate 165 serves to seal the low-pressure portion 110*a* such that the discharged refrigerant is discharged to the high-pressure portion 110*b* without leaking into the low-pressure portion 110*a*.

Referring to FIGS. 1 and 2, the valve assembly 170 according to an embodiment may be disposed between the non-orbiting scroll 150 and the back pressure chamber assembly 160. For example, the valve assembly 170 may be separated from the non-orbiting scroll 150 and/or the back pressure chamber assembly 160 but inserted into the non-orbiting scroll 150 to be fixed between the non-orbiting scroll 150 and the back pressure chamber assembly 160. Thus, the valve assembly 170 may be easily machined or assembled.

Also, the valve assembly 170 may include a discharge valve 1755 and a bypass valve 1751, or may include only the bypass valve 1751 by excluding the discharge valve 1755. However, depending on the shape of the discharge valve 1755, the discharge valve 1755 may also be described as being included in the valve assembly 170. In this embodiment, whereas the discharge valve 1755 is slidably inserted into the valve guide groove 1612*b* disposed in the back pressure plate 161, the bypass valve 1755 is fixed to the retainer block 171 discussed hereinafter. It is described in this embodiment that the discharge valve 1755 and the bypass valve 1751 are included in the valve assembly 170 together with the retainer block 171 discussed hereinafter.

In addition, the valve assembly 170 may be fixedly inserted into the block insertion groove 155 of the non-orbiting end plate 151 as described above. In other words, the block insertion groove 155 is not included in the valve assembly 170 but is a portion into which the valve assembly 170 is inserted. Thus, in broad terms, the block insertion groove 155 may also be included in the valve assembly 170. Therefore, in the following description, the block insertion groove 155 will be described separately from the valve assembly 170, but the portion thereof that is related to the valve assembly 170 will also be described as a portion of the valve assembly 170.

Figure 3:
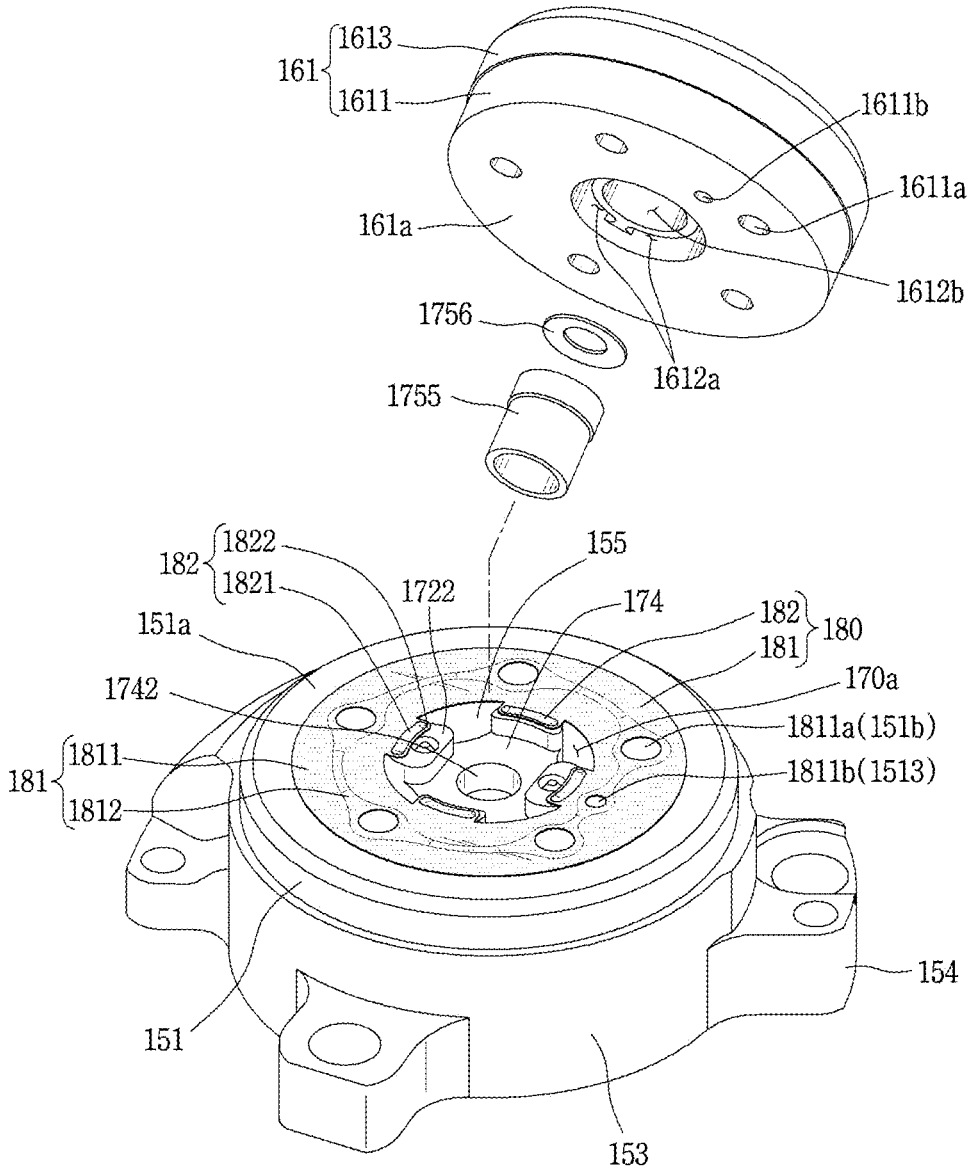
FIG. 3 is a perspective view illustrating a valve assembly assembled with a non-orbiting scroll in FIG. 2.
Figure 4:
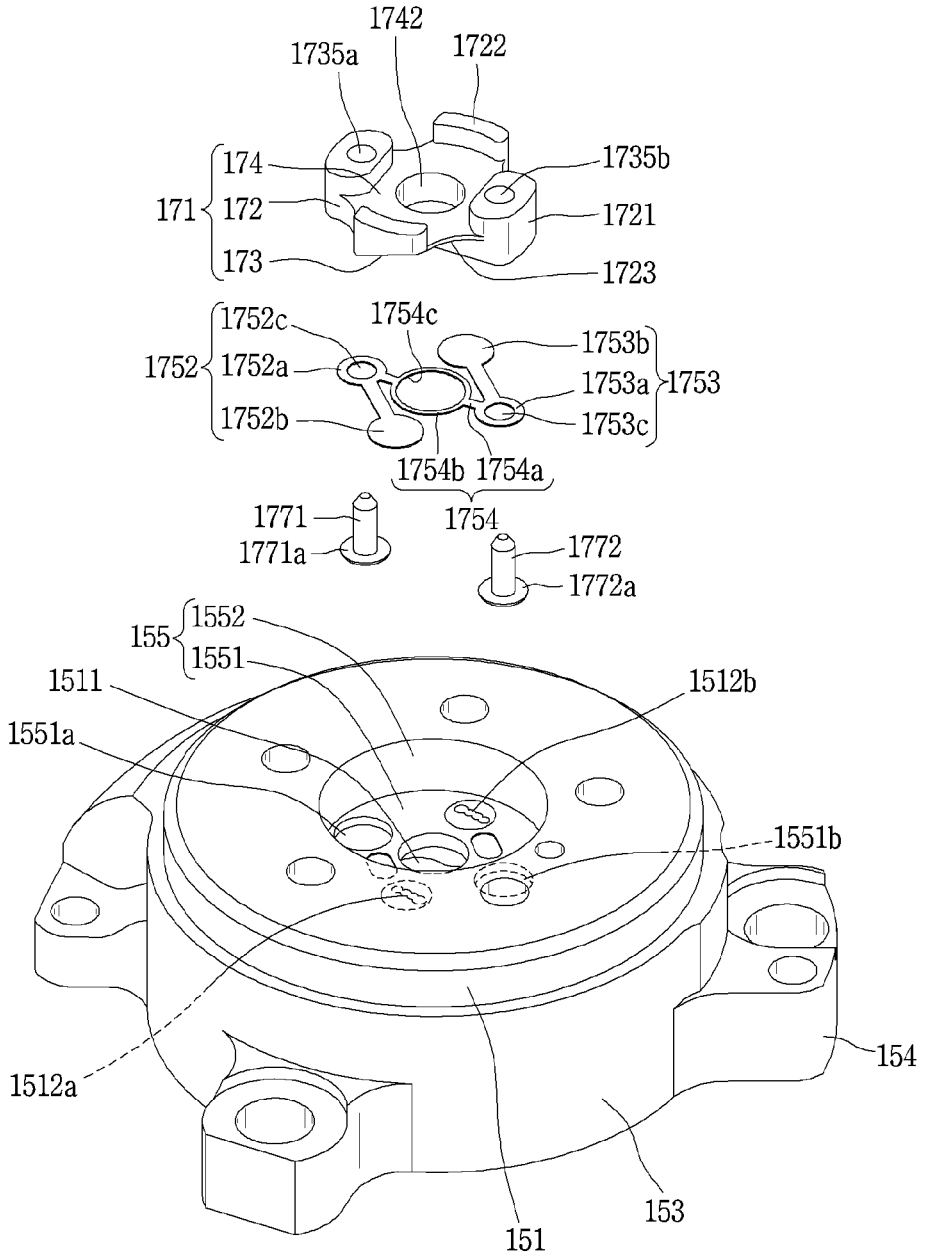
FIG. 4 is a perspective view illustrating the valve assembly of FIG. 3 exploded from a first axial side surface.
Figure 5:
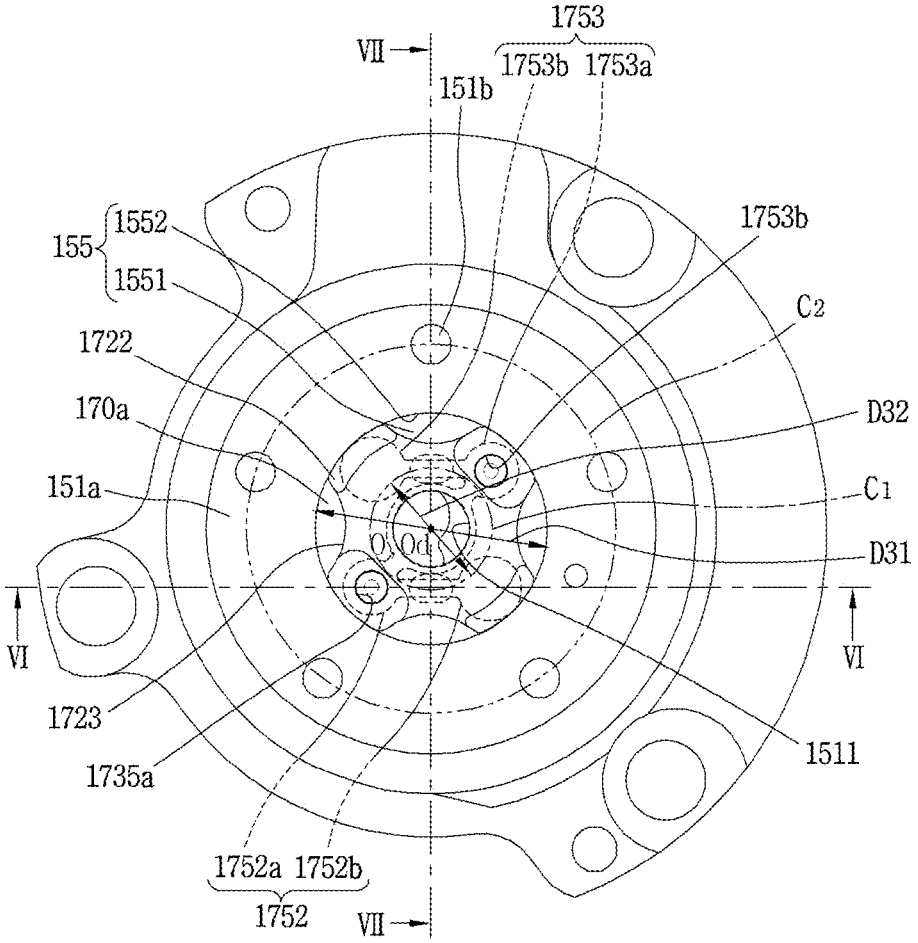
FIG. 5 is a perspective view illustrating the valve assembly assembled with the non-orbiting scroll in FIG. 3.

Referring to FIGS. 3 to 5, the block insertion groove 155 according to this embodiment may be recessed by a preset or predetermined depth into the rear surface 151*a* of the non-orbiting end plate 151 (or the non-orbiting scroll). Accordingly, the block insertion groove 155 may include a block seating surface 1551 defining a bottom surface, and a block accommodating surface 1552 defining an inner circumferential surface (a side wall surface) of the block insertion groove 155 and surrounding the block seating surface 1551.

The block seating surface 1551 may be flat, and the discharge port 1511 and the bypass holes 1512*a* and 1512*b* described above are respectively may extend through the block seating surface 1551. In other words, the discharge port 1511 and the bypass holes 1512*a* and 1512*b* may extend through the block seating surface 1551 in the axial direction. Accordingly, the discharge port 1511 and the bypass hole 1512 may be located inside of the block insertion groove 155.

When the discharge port 1511 and the bypass holes 1512*a* and 1512*b* are disposed inside of the block insertion groove 155 as in this embodiment, a length L1 of the discharge port 1511 and lengths L2 of the bypass holes 1512 are reduced. Accordingly, depending on a shape of the discharge valve 1755 and/or the bypass valve 1751, dead volume in the discharge port 1511 and/or the bypass holes 1512 may be reduced. For example, in a case of a reed valve that opens or closes when first bypass valve 1752 and second bypass valve 1753, which will be described hereinafter, are in contact with or separate from upper surfaces of the first bypass hole 1512*a* and the second bypass hole 1512*b*, respectively, as the lengths L2 and L2 of the respective bypass holes 1512*a* and 1512*b* are shortened, a volume of each of the bypass holes 1512*a* and 1512*b* is reduced, and thus, dead volume may decrease. This is equally expected even in a case in which the bypass valve 1751 is configured as a piston valve.

In addition, a first fastening member accommodating groove 1551*a* and a second fastening member accommodating groove 1551*b* are disposed in the block seating surface 1551 to accommodate a head 1771*a* of the first valve fastening member 1771 and a head 1772*a* of the second valve fastening member 1772 therein. The first valve fastening member 1771 and the second valve fastening member 1772 are configured to fasten the first bypass valve 1752 and the second bypass valve 1753 discussed hereinafter with the retainer block 171. For example, the first fastening member accommodating groove 1551*a* and the second fastening member accommodating groove 1551*b* may be recessed in the block seating surface 1551 to a depth equal to or greater than a height of each of the heads 1771*a* and 1772*a*. Accordingly, the first axial side surface 171*a*, i.e., a lower surface of the retainer block 171, may be firmly supported by being securely adhered to the block seating surface 1551, that is, a bottom surface of the block insertion groove 155.

Figure 6:
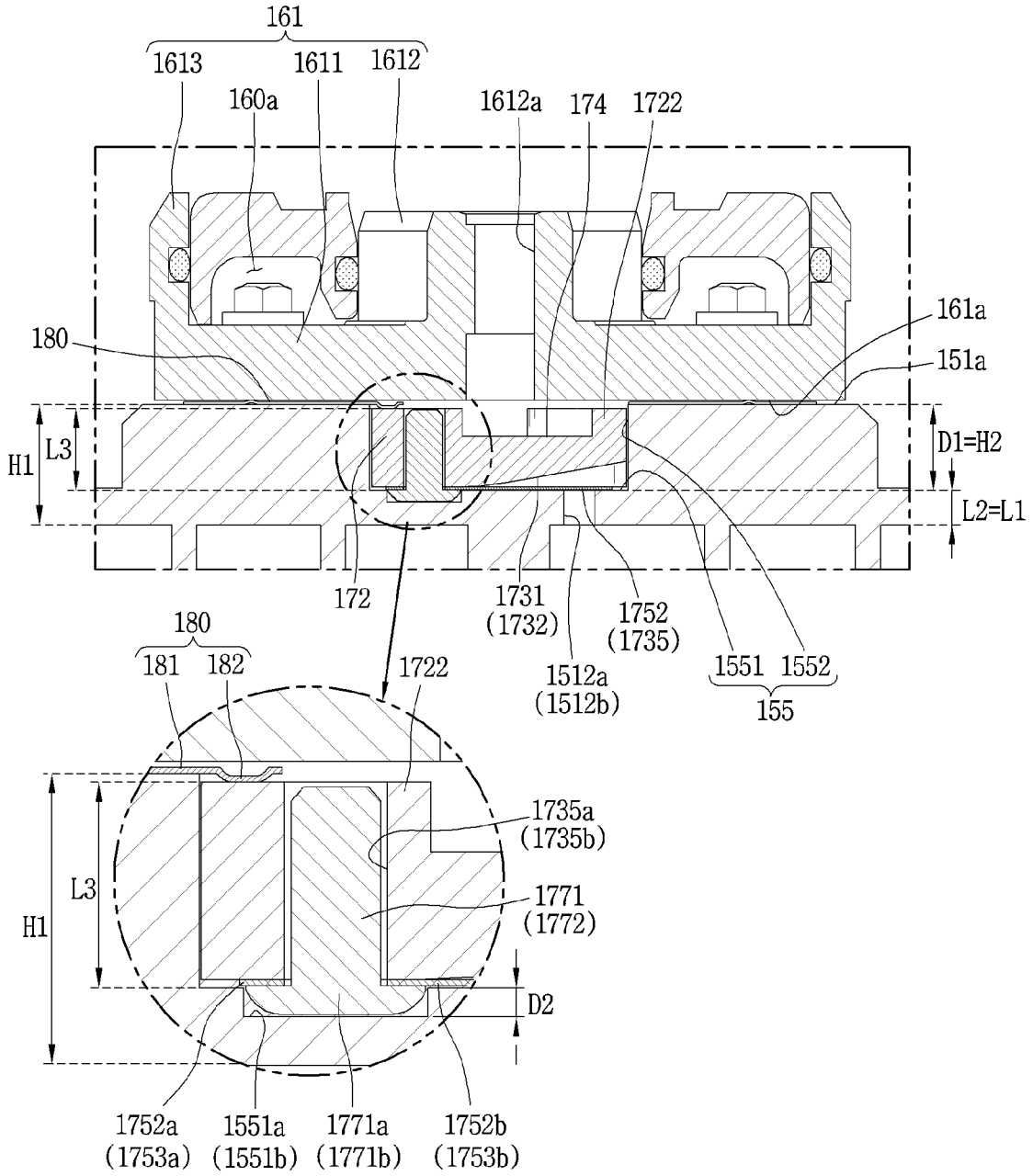
FIG. 6 is a cross-sectional view illustrating the back pressure chamber assembly, taken along a line "VI-VI" of FIG. 5.

Referring to FIG. 6, the first fastening member accommodating groove 1551*a* and the second fastening member accommodating groove 1551*b* may have a relatively small depth because the head 1771*a* of the first valve fastening member 1771 and the head 1772*a* of the second valve fastening member 1772 are inserted therein as described above. In other words, each depth D2 of the first fastening member accommodating groove 1551*a* and the second fastening member accommodating groove 1551*b* may be much smaller than each length L3 of a first valve fastening hole 1735*a* and a second valve fastening hole 1723*a* each included in the block body 172, which will be described hereinafter. Accordingly, as the non-orbiting end plate 151 on the block seating surface 1551 is disposed to have a small thickness, the length L1 of the discharge port 1511 and/or the length L2 of the bypass holes 1512*a* and 1512*b* may be small. Thus, dead volume in the discharge port 1511 and/or the bypass holes 1512*a* and 1512*b* may decrease.

The first fastening member accommodating groove 1551*a* and the second fastening member accommodating groove 1551*b* may be disposed to be as far apart from the first bypass hole 1512*a* and the second bypass hole 1512*b* as possible, while the first bypass valve 1752 and the second bypass valve 1753, which will be described hereinafter, do not interfere with the discharge port 1511. For example, the first fastening member accommodating groove 1551*a* and the second fastening member accommodating groove 1551*b* may be positioned on a second center line CL2 perpendicular to a first center CL1 at a center Od of the discharge port 1511, the first center CL1 connecting the center Od to a center to a center Ob1 of the first bypass hole 1512*a* and a center Ob2 of the second bypass hole 1512*b* positioned respectively at both sides of the center Od. Accordingly, the first bypass valve 1752 and the second bypass valve 1753, which will be described hereinafter, may be disposed to be as far apart from the first bypass hole 1512*a* and the second bypass hole 1512*b* as possible without interfering with the discharge port 1511. By doing so, the first bypass valve 1752 and the second bypass valve 1753 may be ensured to have great opening/closing lengths to suppress or prevent overcompression and/or collision noise. This will be described hereinafter together with the retainer block 171 and/or the bypass valve 1751.

Figure 7:
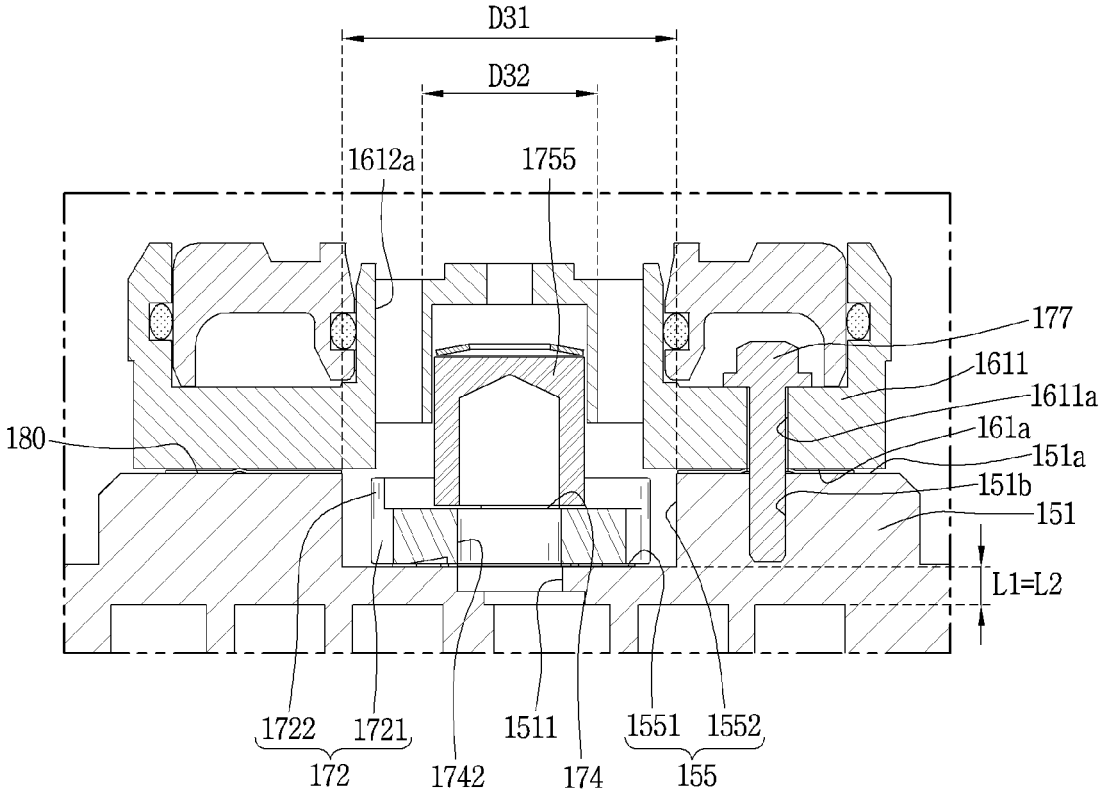
FIG. 7 is a sectional view illustrating the back pressure chamber assembly, taken along a line "VII-VII" of FIG. 5.

Although not illustrated, the first fastening member accommodating groove (not shown) and/or the second fastening member accommodating groove (not shown) may be recessed in a first axial side surface 171*a* of the retainer block 171 facing the block seating surface 1551 of the block insertion groove 155, that is, inlets of the valve fastening holes 1722*a* and 1723*a*. In this case, peripheries of a valve through-hole 1752*c* of the first bypass valve 1752 and a valve through-hole 1753*c* of the second bypass valve 1753 may be concave to correspond to the first and second fastening member accommodating grooves. As described above, when the first fastening member accommodating groove and/or the second fastening member accommodating groove are disposed in the first axial side surface 171*a* of the retainer block 171, the non-orbiting end plate 151 may have a smaller thickness compared to the embodiment described above. By doing so, the length L1 of the discharge port 1511 and/or the lengths LS and L2 of the respective bypass holes 1512*a* and 1512*b* may be reduced compared to the embodiment described with reference to FIGS. 6 and 7 to thereby further decrease dead volume.

Although not illustrated, the first fastening member accommodating groove (not shown) and/or the second fastening member accommodating groove (not shown) may be disposed to partially correspond to the block seating surface 1551 of the block insertion groove 155 and the first axial side surface 171*a* of the retainer block 171 facing the block seating surface 1551, respectively. Even in this case, the non-orbiting end plate 151 may have a small thickness, and thus, the length L1 of the discharge port 1511 and/or the lengths L2 and L2 of the respective bypass holes 1512*a* and 1512*b* may be further reduced compared to the embodiment described with reference to FIGS. 6 and 7 to thereby further decrease the dead volume.

Referring to FIGS. 4 and 5, the block accommodating surface 1552 according to this embodiment may have a circular cross-sectional shape when being axially projected. For example, the block accommodating surface 1552 may be provided in a circular cross-sectional shape with the center Od of the discharge port 1511 as a center of a circle. Accordingly, the block insertion groove 155 including the block accommodating surface 1552 may be easily machined.

The block accommodating surface 1552 may have a circular cross-sectional shape when axially projected, and an inner diameter D31 of the block accommodating surface 1552 may be greater than a diameter D32 of a first virtual circle C1 connecting an inner circumferential surface of the intermediate discharge port 1612*a*. Accordingly, the block accommodating surface 1552 may have a circular cross-sectional shape, and a discharge guide passage 170*a* constituted by an inner circumferential surface of the block accommodating surface 1552 may smoothly communicate with the intermediate discharge port 1612*a*.

The block accommodating surface 1552 may be disposed at a position that does not overlap the back pressure fastening grooves 151*b*. In other words, the plurality of back pressure fastening grooves 151*b* for fastening the back pressure plate 161 to the non-orbiting scroll 150 may be disposed in the rear surface 151*a* of the non-orbiting end plate 151, and the block accommodating surface 1552 defining an inner circumferential surface of the block insertion groove 155 may be located in a second virtual circle C2 (see FIG. 5) connecting centers of the back pressure fastening grooves 151*b* in a circumferential direction. Accordingly, the back pressure fastening grooves 151*b* may be located outside of the block insertion groove 155, and thus, may be disposed deeply even when the thickness H1 of the non-orbiting end plate 151 in the block insertion groove 155 becomes thin. This may ensure fastening strength of the back pressure fastening bolts 177.

However, as described above, when the block insertion groove 155 including the block accommodating surface 1552 has a circular cross-sectional shape, it may be difficult to ensure sufficient opening/closing lengths of the first bypass valve 1752 and the second bypass valve 1753, which will be described hereinafter. Then, as an elastic force of the first bypass valve 1752 and an elastic force of the second bypass valve 1753 increase excessively, opening operations of the first bypass valve 1752 and the second bypass valve 1753 may be delayed, and thus, overcompression may occur or a closing operation may be accelerated, thereby resulting in an increase in collision noise.

Figure 10:
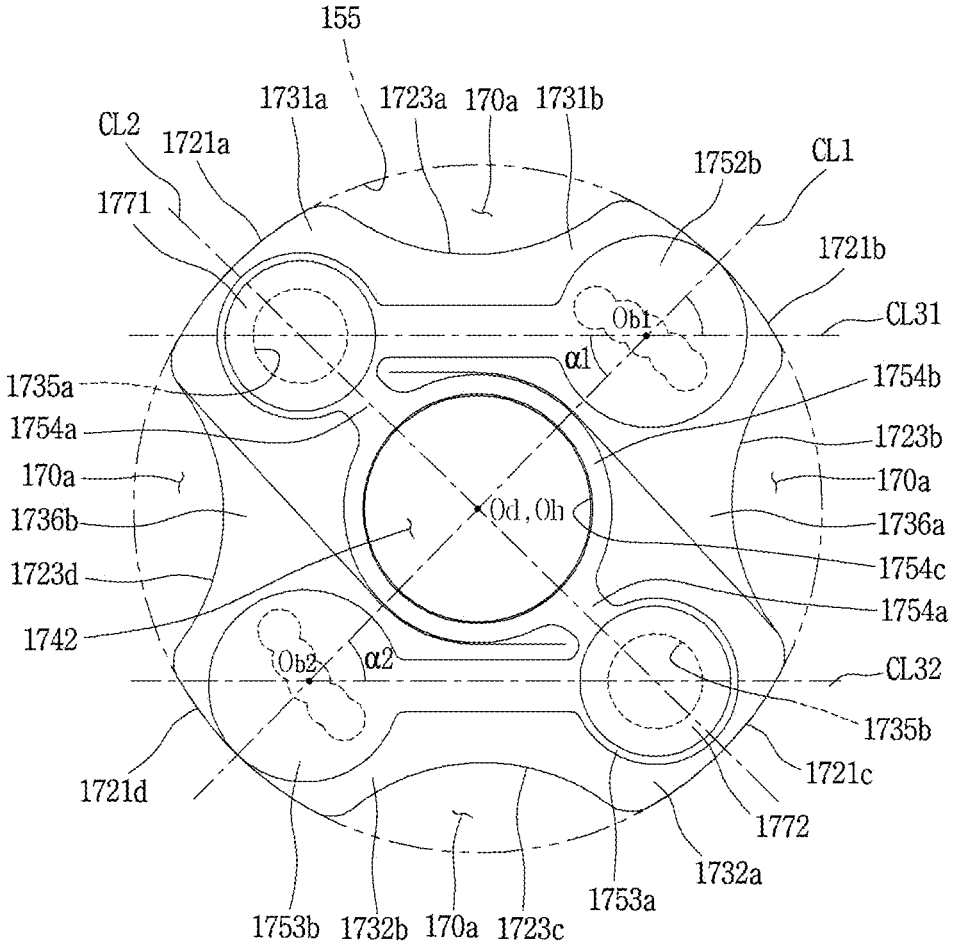
FIG. 10 is a bottom view of the bypass valve assembled with the retainer block of FIG. 9.
Figure 11:
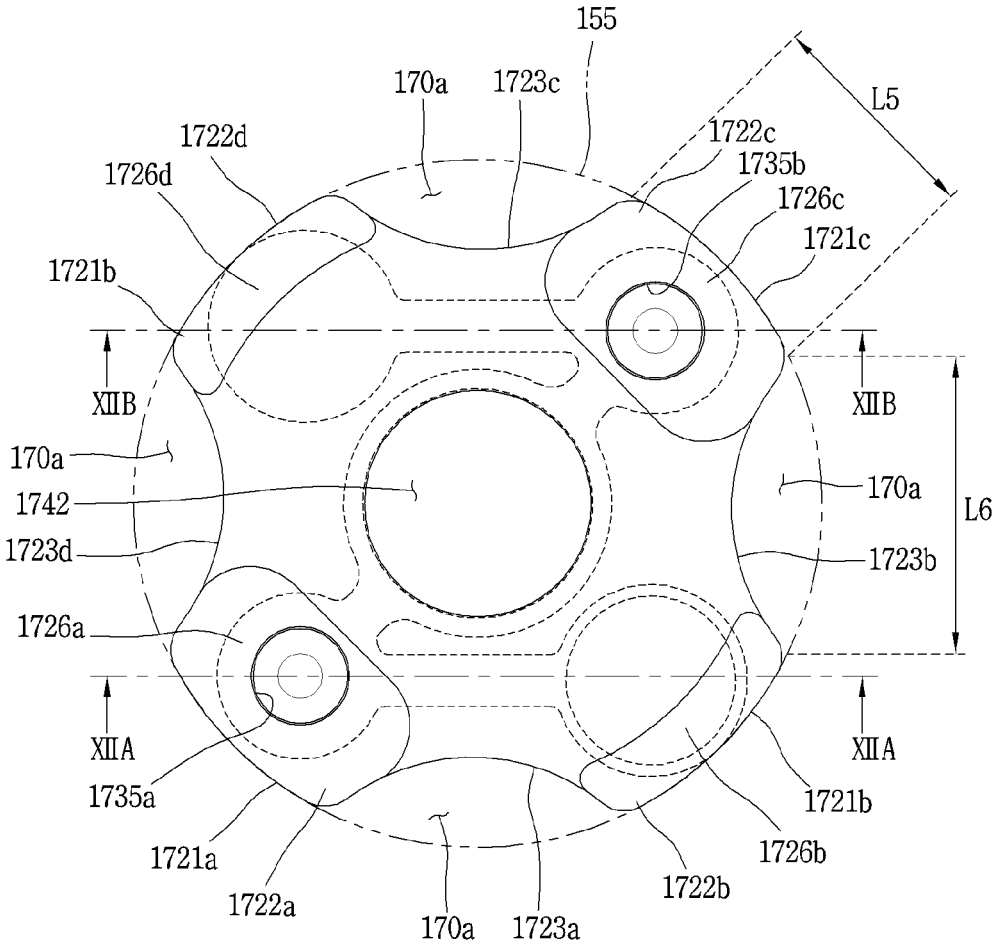
FIG. 11 is a planar view of the bypass valve assembled with the retainer block of FIG. 9.
Figure 12A:
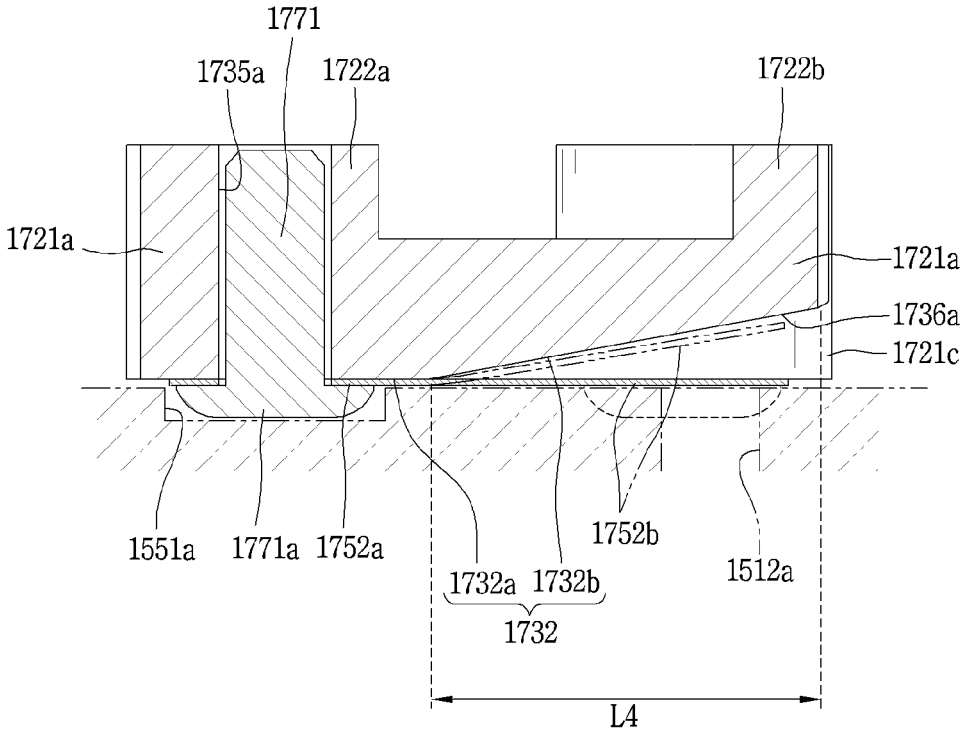
FIGS. 12A and 12B are cross-sectional views, taken along lines "XXIA-XIIA" and "XIIB-XIIB" of FIG. 11, respectively.

Accordingly, in this embodiment, the first bypass valve 1752 and the second bypass valve 1753 are disposed parallel to each other, and as illustrated in FIGS. 10 to 12, may be inclined at a preset or predetermined angle relative to a first center line CL1 described above. In other words, the first bypass valve 1752 may be inclined such that an angle α1 (hereinafter referred to as a first contained angle) of a longitudinal center line CL31 of the first bypass valve 1752 relative to the first center line CL1 corresponds to an angle smaller than a right angle, that is, an acute angle in a direction toward the discharge port 1511. For example, the first contained angle α1 may be inclined by approximately 45°. This is also applied to the second bypass valve 1753. That is, the second bypass valve 1753 may be inclined such that an angle α2 (hereinafter referred to as a second contained angle) of a longitudinal center line CL32 of the second bypass valve 1753 relative to the first center line CL1 corresponds to an acute angle in a direction toward the discharge port 1511. For example, the second contained angle α2 may be inclined by approximately 45°. Accordingly, the block accommodating surface 1552 may have a circular shape, and the first bypass valve 1752 and the second bypass valve 1753 may be ensured to have as great an opening/closing length as possible to thereby suppress or prevent overcompression and/or collision noise. This will be described hereinafter together with the retainer block 171.

Referring to FIGS. 8 to 12, the valve assembly 170 according to this embodiment may include the retainer block 171 and a valve 175. The retainer block 171 may be fixedly inserted into the block insertion groove 155 in the non-orbiting end plate 151, and the valve 175 may be supported by or fastened to the retainer block 171 to be disposed between the back pressure plate 161 and the retainer block 171 or between the non-orbiting end plate 151 and the retainer block 171. Accordingly, the retainer block 171 and the valve 175 may be modularized into the valve assembly 170 so that the valve 175, for example, the bypass valve 1751 may be easily assembled. In addition, as described above, as the bypass valve 1751 constituting a portion of the valve 175 is inserted into the block insertion groove 155, the lengths L2 of the bypass holes 1512 is reduced accordingly, and thus, dead volume in the bypass hole 1512 may be reduced.

An outer circumferential surface of the retainer block 171 according to this embodiment may have a non-circular shape. However, in some cases, the outer circumferential surface of the retainer block 171 may have a circular shape. However, as described above, as the inner circumferential surface of the block insertion groove 155 has a circular shape, the outer circumferential surface of the retainer block 171 may have a non-circular shape to help to discharge bypassed refrigerant.

In other words, the discharge guide passage 170*a* for guiding refrigerant discharged from the bypass holes 1512 to the intermediate discharge port 1612*a* needs to be disposed between the inner circumferential surface of the block insertion groove 155 and the outer circumferential surface of the retainer block 171. In this case, when the outer circumferential surface of the retainer block 171 has a same circular cross-sectional shape as that of the outer circumferential surface of the block insertion groove 155, the outer diameter of the retainer block 171 needs to be reduced. Accordingly, the opening/closing length of the bypass valve 1751 may be reduced. Accordingly, unlike the inner circumferential surface of the block insertion groove 155, the outer circumferential surface of the retainer block 171 may be disposed to have a non-circular cross-sectional shape not only to stably fix the retainer block 171 but also to increase a substantial outer diameter of the retainer block 171, thereby ensuring an opening/closing length of the bypass valve 1751.

The retainer block 171 according to this embodiment may include the block body 172, a bypass valve support portion 173, and a discharge valve accommodating portion 174. The bypass valve support portion 173 and the discharge valve accommodating portion 174 may be disposed on both side surfaces of a block body 172 in an axial direction, respectively. For example, the bypass valve support portion 173 may be disposed on first axial side surface 171*a* of the retainer block 171 positioned on a surface the block body 172 facing the non-orbiting scroll 150, and the discharge valve accommodating portion 174 is disposed on second axial side surface 171*b* of the retainer block 171 positioned on a surface the block body 172 facing the back pressure assembly 160. Accordingly, compressor efficiency may be improved by further reducing dead volume in the bypass holes 1512 in which a dead volume loss is relatively great compared to the discharge port 1511.

Referring to FIGS. 8 to 11, the block body 172 may include radial fixing protrusions 1721, axial fixing protrusions 1722, and discharge guide grooves 1723. The radial fixing protrusions 1721 are portions extending in a radial direction, and radially extend at predetermined intervals along a circumferential direction to be fixed in close contact with or almost in close contact with an inner circumferential surface of the block insertion groove 155. The axial fixing protrusions 1722 are portions axially extending from the radial fixing protrusions 1721 in pairs with the axial fixing protrusions 1721, respectively, and are fixed in close contact with or almost in close contact with a rear surface 161*a* of the back pressure plate 161 (or supported by a gasket discussed hereinafter). The discharge guide grooves 1723 are portions guiding refrigerant discharged through the discharge port 1511 and/or the bypass holes 1512 to the intermediate discharge port 1612*a*, and are disposed between the radial fixing protrusions 1721 and/or the axial fixing protrusions 1722 to be spaced apart from the inner circumferential surface of the block insertion groove 155 to thereby define the discharge guide passage 170*a*.

For example, when four radial fixing protrusions 1721, four axial fixing protrusions 1722, and four discharge guide grooves 1723 are provided, the four radial fixing protrusions 1721, the four axial fixing protrusions 1722, and the four discharge guide grooves 1723 may be defined as first to fourth radial fixing protrusions 1721*a* to 1721*d*, first to fourth axial fixing protrusions 1722*a* to 1722*d*, and first to fourth discharge guide grooves 1723*a* to 1723*d*, respectively, along a clockwise or counterclockwise direction. In other words, a discharge guide groove 1723 between the first radial fixing protrusion 1721*a* (or the first axial fixing protrusion) and the second radial fixing protrusion 1721*b* (or the second axial fixing protrusion) may be defined as the first discharge guide groove 1723*a*, a discharge guide groove 1723 between the second radial fixing protrusion 1721*b* (or the second axial fixing protrusion) and the third radial fixing protrusion 1721*c* (or the third axial fixing protrusion) may be defined as the second discharge guide groove 1723*b*, a discharge guide groove 1723 between the third radial fixing protrusion 1721*c* (or the third axial fixing protrusion) and the fourth radial fixing protrusion 1721*d* (or the fourth axial fixing protrusion) may be defined as the third discharge guide groove 1723*c*, and a discharge guide groove 1723 between the fourth radial fixing protrusion 1721*d* (or the fourth axial fixing protrusion) and the first radial fixing protrusion 1721*a* (or the first axial fixing protrusion) may be defined as the fourth discharge guide groove 1723*d* for description.

Referring to FIGS. 8 to 12, the radial fixing protrusions 1721 according to this embodiment is a portion defining an outer circumferential surface of the block body 172, and may radially extend at a preset or predetermined interval along a circumferential direction. In other words, a plurality of the axial fixing protrusions 1721 (four as shown in FIGS. 8-11) extends in the radial direction, and may be disposed at the same intervals with the discharge guide grooves 1723 interposed therebetween in the circumferential direction. Accordingly, as described above, the block body 172 has a non-circular cross-sectional shape when projected in the axial direction to define a portion of the discharge guide passage 170*a* between an inner circumferential surface of the block insertion groove 155 and an outer circumferential surface of the block body 172.

As outer circumferential surfaces of the radial fixing protrusions 1721 is almost in contact with an inner circumferential surface of the block insertion groove 155, the outer circumferential surfaces of the radial fixing protrusions 1721 may be disposed to have almost a same curvature as that of the inner circumferential surface of the block insertion groove 155. Accordingly, a contact area between the outer circumferential surface of the axial fixing protrusion 1721 and the inner circumferential surface of the block insertion groove 155 increases, and thus, that the block body 172 may be stably supported in the block insertion groove 155 in a transverse direction (or radial direction).

For example, a length L5 of each of the radial fixing protrusions 1721 may be smaller than or equal to a length L6 of each of the discharge guide grooves 1723. In other words, as the axial fixing protrusions 1721 correspond to support surfaces included in the block body 172, the axial fixing protrusions 1721 may be disposed to have as wide an area as possible. However, as the axial fixing protrusions 1721 may be a certain obstacle to the discharge guide passage 170*a*, it may be desirable to configure the axial fixing protrusions 1721 to have as small an area as possible to help to discharge refrigerant. However, in this embodiment, as the plurality of axial fixing protrusions 1721 is disposed at the same intervals along the circumferential direction, even when the length L5 of the axial fixing protrusions 1721 is equal to or slightly smaller than the length L6 of the discharge guide grooves 1723, the block body 172 may be relatively stably supported with respect to the block seating surface 1551 and/or the block accommodating surface 1552. Accordingly, when the length L5 of the axial fixing protrusions 1721 is smaller than or equal to the length L6 of the discharge guide grooves 1723, the block body 172 may be stably supported, and at same time, the discharge guide passage 170*a* may be ensured to have as large a cross-sectional area as possible.

Referring to FIGS. 8 to 12, the axial fixing protrusions 1722 are portions constituting the second axial side surface 171*b* of the retainer block 171 (or block body), and may be disposed to axially extend from the axial fixing protrusions 1721. For example, an axial cross-sectional shape of the axial fixing protrusions 1722 may be provided to be almost the same as an axial cross-sectional shape of the radial fixing protrusions 1721.

Like the radial fixing protrusions 1721, a plurality of the axial fixing protrusions 1722 may be disposed to have the discharge guide grooves 1723 therebetween and extend in the axial direction, and have axial cross-sectional areas, respectively, different from each other. In other words, the axial cross-sectional areas of block support surfaces 1726*a* to 1726*d* constituting respective upper surfaces of the axial fixing protrusions 1722 (or the second axial side surface of the retainer block) may be different from each other.

For example, axial cross-sectional areas of the block support surfaces 1726*b* and 1726*d* of the axial fixing protrusions 1722*b* and 1722*d* (second and fourth axial fixing protrusions) in which the first valve fastening hole 1735*a* and a second valve fastening hole 1735*b* are not disposed, may be smaller than axial cross-sectional areas of the block support surfaces 1726*a* and 1726*c* of the axial fixing protrusions 1722*a* and 1722*c* (first and third axial fixing protrusions) in which the first valve fastening hole 1735*a* and the second valve fastening hole 1735*b* are not disposed. In other words, the axial cross-sectional areas of the axial fixing protrusions 1722*b* and 1722*d* extending from the radial fixing protrusions 1722*b* and 1722*d* (second and/or fourth axial fixing protrusions) in which the first valve opening/closing surface 1731*b* and the second valve opening/closing surface 1732*b* are disposed may be smaller than the axial cross-sectional areas of the axial fixing protrusions 1722*a* and 1722*c* extending from the radial fixing protrusions 1721*a* and 1721*c* (the first and/or third radial fixing protrusions) in which a first valve fixing surface 1731*a* and/or a second valve fixing surface 1732*a* are disposed. Accordingly, a cross-sectional area of the discharge valve accommodating portion 174, which will be described hereinafter, is enlarged to thereby reduce discharge resistance in the discharge valve accommodating portion 174. Thus, refrigerant discharged through the discharge port 1511 and/or the bypass holes 1512 may be quickly moved through the intermediate discharge port 1612*a*.

Although not shown in the drawings, the plurality of axial fixing protrusions 1722 may have a same axial cross-sectional area. For example, the axial cross-sectional areas of the first to fourth axial fixing protrusions 1722*a* to 1722*d* may be identical to each other regardless of whether or not the first valve fastening hole 1735*a* and the second valve fastening hole 1735*b*, which will be described hereinafter, are provided, or whether or not the block support surfaces 1726*a* to 1726*d* extend therethrough. Accordingly, as the block body 172 receives almost a same axial supporting force in the circumferential direction due to the back pressure chamber assembly 160 (more specifically, a block support portion of the gasket), the block body 172 may be stably fixed, and thus, behavior of the discharge valve 1755 as well as the bypass valve 1751 may be stabilized.

Also, the plurality of axial fixing protrusions 1722 may have a same height. In other words, the respective block support surfaces 1726*a* to 1726*d* may be located at a same height in the axial direction. Accordingly, the block body 172 may be stably fixed by receiving a uniform support force from the back pressure plate 161 (for example, the block support portion of the gasket).

In addition, the plurality of axial fixing protrusions 1722*a* to 1722*d* may be configured such that the respective block support surfaces 1726*a* to 1726*d* are located at a height level lower than or the same as that of an upper end of the block accommodating surface 1552. For example, a height H2 from the block seating surface 1551 to each of the block support surfaces 1726*a* to 1726*d* may be equal to or smaller than a depth D1 of the block insertion groove 155. Accordingly, while the retainer block 171 is fixed between the non-orbiting scroll 150 and the back pressure chamber assembly 160, the non-orbiting scroll 150 and the back pressure chamber assembly 160 may be in close contact with each other to have gasket 180 discussed hereinafter disposed therebetween. Thus, a space between the first and second back pressure hole 1513 and 1611*b* at both sides may be securely sealed resulting from the use of gasket 180.

However, in this embodiment, it is illustrated that a height of each of the plurality of axial fixing protrusions 1722, that is, the height H2 of each of the block support surfaces 1726*a* to 1726*d* is slightly smaller than the depth D1 of the block insertion groove 155. Accordingly, a block support portion 182 extending toward the axial fixing protrusions 1722 of the block body 172 to support the block body 172 in the axial direction may extend from an inner circumferential surface of the gasket 180, which will be described hereinafter. The block support portion 182 of the gasket 180 will be described again hereinafter.

Referring to FIGS. 8 to 12, as described above, the discharge guide grooves 1723 may be disposed between the plurality of radial fixing protrusions 1721. In other words, the discharge guide grooves 1723 may be defined as a gap between the axial fixing protrusions 1721 in the circumferential direction. Accordingly, an inner circumferential surface of the discharge guide grooves 1723 constitutes an outer circumferential surface of the block body 172 together with outer circumferential surfaces of the axial fixing protrusions 1721.

The discharge guide grooves 1723 may have a linear surface or a curved surface. In this embodiment, the discharge guide grooves 1723 is illustrated as having a curved surface. Accordingly, the discharge guide grooves 1723 may be easily machined.

In addition, the discharge guide grooves 1723 may have a convex form to have a same curvature as that of the block accommodating surface 1552 or a concave form in a direction away from the block accommodating surface 1552. In this embodiment, the discharge guide grooves 1723 is illustrated as having a concave form. Accordingly, while the discharge guide grooves 1723 is easily processed, a central portion of the discharge guide grooves 1723 may have a great depth to thereby ensure a large cross-sectional area of the discharge guide passage 170*a* in correspondence with the depth.

Figure 8:
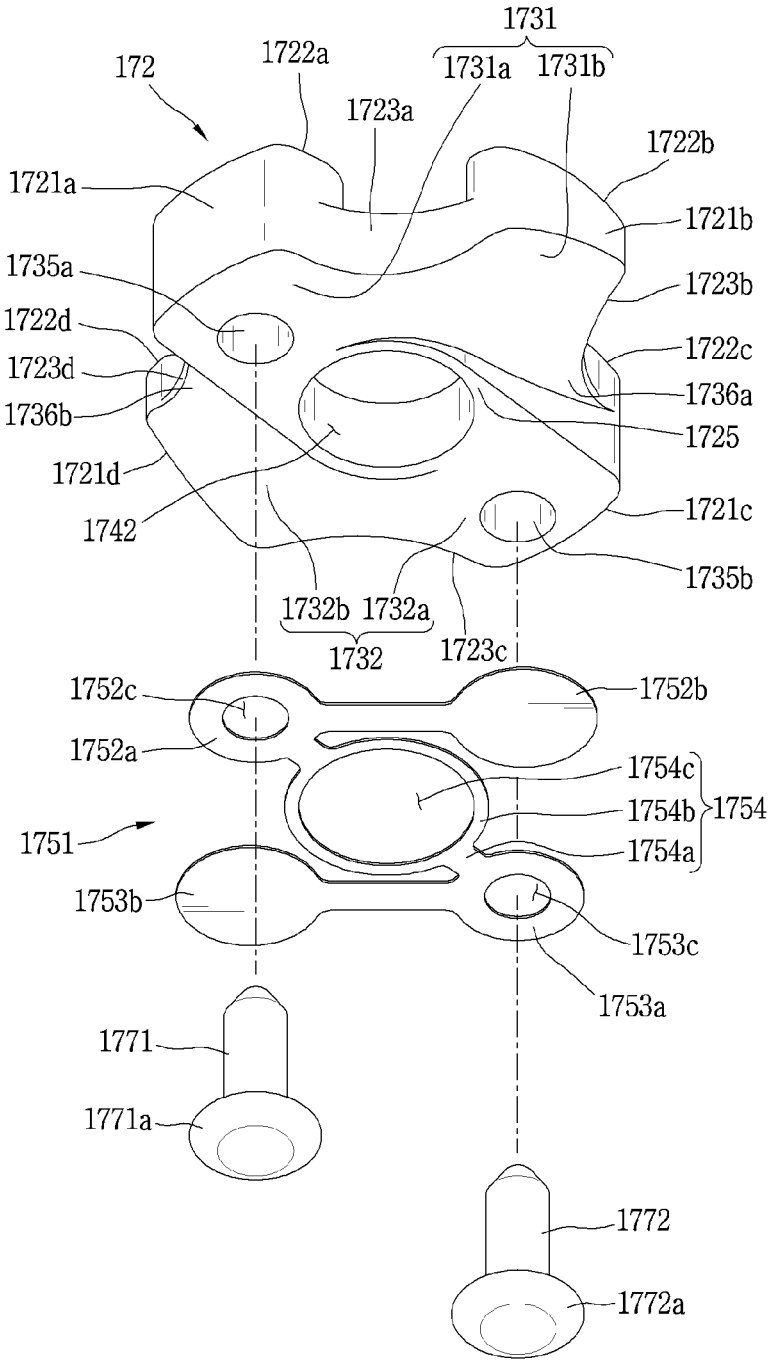
FIG. 8 is an exploded perspective view illustrating a bypass valve disassembled from a retainer block.
Figure 9:
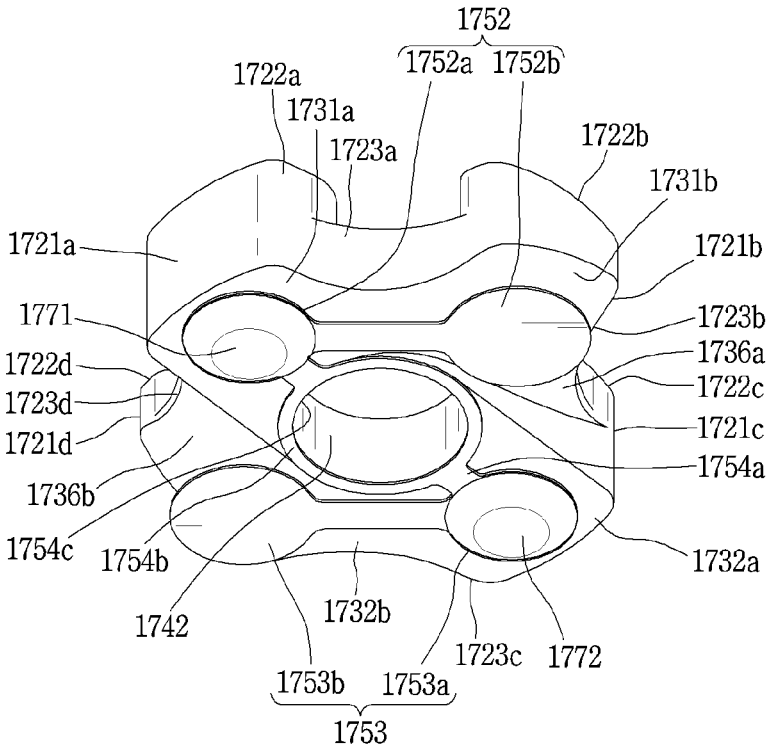
FIG. 9 is a perspective view illustrating the bypass valve assembled with the retainer block.

Referring to FIGS. 8 to 10, the bypass valve support portion 173 according to this embodiment is disposed on the first axial side surface 171*a* of the retainer block 171 as described above, and may be disposed on both sides in a transverse direction with reference to a discharge guide hole 1742 discussed hereinafter. For example, the bypass valve support portion 173 may include a first valve support portion 1731 and a second valve support portion 1732, and the first valve support portion 1731 and the second valve support portion 1732 may be disposed on both sides in a transverse direction, respectively, with reference to the discharge guide hole 1742, which will be described hereinafter. Assembly positions of the first valve support portion 1731 and the second valve support portion 1732 are opposite to each other, but shapes and operations thereof are inversely-symmetrical to each other. Thus, hereinafter, description will be provided with reference to the first valve support portion 1731, and the second valve support portion 1732 will be briefly described with reference to the description about the first valve support portion 1731.

The first valve support portion 1731 may include the first valve fixing surface 1731*a* and a first valve opening/closing surface 1731*b*. The first valve fixing surface 1731*a* is a surface to which a first fixing portion 1752*a* of the first bypass valve 1752 discussed hereinafter is fastened, and the first valve opening/closing surface 1731*b* is a surface which the first opening/closing portion 1752*b* is in contact with or separate from to thereby limit a degree of opening.

The first valve support portion 1731 may be disposed across two neighboring axial fixing protrusions 1721 and two neighboring discharge guide grooves 1723. For example, among two neighboring axial fixing protrusions 1721, the first valve fixing surface 1731*a* may be disposed on one (first) axial fixing protrusion 1721, and the first valve opening/closing surface 1731*b* may be disposed throughout another (second) axial fixing protrusion 1721 and both discharge guide grooves 1723 having the another (second) axial fixing protrusion 1721 therebetween.

In other words, the first valve fixing surface 1731*a* may be disposed on one axial side surface of the first radial fixing protrusion 1721*a*, and the first valve opening/closing surface 1731*b* may be disposed across the second radial fixing protrusion 1721*b* and the first and second discharge guide grooves 1723*a* and 1723*b* located at both sides of the second radial fixing protrusion 1721*b*. Accordingly, whereas the first valve fixing surface 1731*a* is narrow, the first valve opening/closing surface 1731*b* is wider than the first valve fixing surface 1731*a*. Thus, the first bypass valve 1752 may be ensured to have a great length even inside of the narrow block insertion groove 155.

The first valve fixing surface 1731*a* may be flat on the first axial side surface 171*a* of the retainer block 171 (or the block body) facing the block seating surface 1551, that is, a lower surface of the first radial fixing protrusion 1721*a*. Accordingly, the first valve fixing surface 1731*a* may be fixedly in close contact with the rear surface 151*a* of the non-orbiting end plate 151, together with the first fixing portion 1752*a* of the bypass valve 1751, which will be described hereinafter.

One (first) end of the first valve fastening hole 1735*a* is disposed on the first valve fixing surface 1731*a*. In other words, the first valve fastening hole 1735*a* may penetrate through the first radial fixing protrusion 1721*a* in the axial direction such that the one end penetrates through the first valve fixing surface 1731*a* and another (second) end penetrates through an upper surface of the first axial fixing protrusion 1722*a*, that is, the first block support surface 1726*a* discussed hereinafter. Accordingly, the first bypass valve 1752 may be brought into close contact with the first valve fixing surface 1731*a* facing the block seating surface 1551 to be stably fixed to the first valve fixing surface 1731*a*.

Although not illustrated in the drawing, a first valve fastening groove (not shown) may be disposed in the first valve fixing surface 1731*a* to be recessed by a preset or predetermined depth along the axial direction toward the first block support surface 1726*a* discussed hereinafter. Hereinafter, for convenience, it is described that the first valve fastening groove is included in the first valve fastening hole 1735*a*.

The first valve fastening member 1771 penetrating through the first fixing portion 1752*a* of the first bypass valve 1752 discussed hereinafter, for example, a fastening bolt or fastening rivet is fixedly inserted into the first valve fastening hole 1735*a*. This embodiment illustrates an example in which the fastening rivets are applied. Accordingly, in a state in which the first bypass valve 1751 is supported on the first valve fixing surface 1731*a* of the first radial fixing protrusion 1721*a*, the head 1771*a* of the first valve fastening member 1771 may be inserted and fastened into the first valve fastening hole 1735*a* from a lower side to an upper side, that is, from the non-orbiting scroll 150 toward the back pressure chamber assembly 160.

In this case, the head 1771*a* of the first valve fastening member 1771 is inserted and buried into the first fastening member accommodating groove 1551*a* in the block insertion groove 155 described above. Accordingly, the head 1771*a* of the first valve fastening member 1771 may protrude toward a lower side of the block body 172, and the block body 172 may be fixed by the head 1771*a* of the first valve fastening member 1771 to be in close contact with a bottom surface of the block insertion groove 155 without being lifted therefrom. In addition, as the non-orbiting plate portion 151 may be thin in the block insertion groove 155, lengths of the discharge port 1511 and/or the bypass holes 1512*a* and 1512*b* are shortened accordingly. Thus, dead volume in the discharge port 1511 and/or in the bypass holes 1512*a* and 1512*b* may be reduced.

Referring to FIGS. 10 to 12A, the first valve opening/closing surface 1731*b* may be inclined with respect to the second center line CL2 discussed hereinafter. For example, when projected in the axial direction, the first valve opening/closing surface 1731*b* may be inclined from the first radial fixing protrusion 1721*a*, on which the first valve fixing surface 1731*a* is disposed, toward the second radial fixing protrusion 1721*b* neighboring the first radial fixing protrusion 1721*a*, and may be inclined approximately at an acute angle smaller than a right angle relative to the second center line CL2. Accordingly, the block insertion groove 155 may have a circular shape, and a length L4 of the first valve opening/closing surface 1731*b* may be maximized.

In addition, the first valve opening/closing surface 1731*b* may be disposed to be gradually spaced apart from the block seating surface 1551, as the first valve opening/closing surface 1731*b* is increasingly apart from the first valve fixing surface 1731*a*. For example, the first valve opening/closing surface 1731*b* may be inclined or curved. Accordingly, the first bypass valve 1752 may rotate around the first valve fixing surface 1731*a* to be separate from or in contact with to the first valve opening/closing surface 1731*b* to thereby limit a degree of opening of the first bypass valve 1752.

In addition, the first valve opening/closing surface 1731*b* may have a larger cross-sectional area in a portion of the second radial fixing protrusion 1721*b* than a cross-sectional area in a portion of the first valve fixing surface 1731*a* at an opposite side. For example, as described above, the first valve opening/closing surface 1731*b* may be disposed to extend from an end, toward the first discharge guide groove 1723*a*, of the first radial fixing protrusion 1721*a* to the second discharge guide groove 1723*b* through the second radial fixing protrusion 1721*b*. Accordingly, another end of the first valve opening/closing surface 1731*b*, that is, an opposite side of the first valve fixing surface 1731*a* ranges from an outer circumferential surface of the second radial fixing protrusion 1721*b* to an end, toward the third radial fixing protrusion 1721*c*, of the second discharge guide groove 1723*b*. Thus, a cross-sectional area of the first valve opening/closing surface 1731*b* may increase toward the second radial fixing protrusion 1721*b*.

In other words, the first valve opening/closing surface 1731*b* is disposed to overlap the first discharge guide groove 1723*a* and the second discharge guide groove 1723*b* in longitudinal and widthwise directions, and a first discharge guide surface 1736*a* for quickly guiding refrigerant bypassed through the first bypass holes 1512*a* toward the intermediate discharge port 1612*a* may be disposed on an end portion of the first valve opening/closing surface 1731*b* toward the second radial fixing protrusion 1721*b* at an opposite side of the first radial fixing protrusion 1721*a*.

For example, the first discharge guide surface 1736*a* may extend in the longitudinal direction from a middle of the first valve opening/closing surface 1731*b* toward the second discharge guide groove 1723*b*, and at the same time, extend toward a circumferential side surface of the third radial fixing protrusion 1721*c* in the widthwise direction. Accordingly, when projected in the axial direction, the first discharge guide surface 1736*a* may have an approximately triangular shape with a great width toward the second discharge guide groove 1723*b* to thereby expand the discharge guide passage 170*a*. Thus, the bypassed refrigerant may quickly move toward the intermediate discharge port 1612*a*.

Figure 12B:
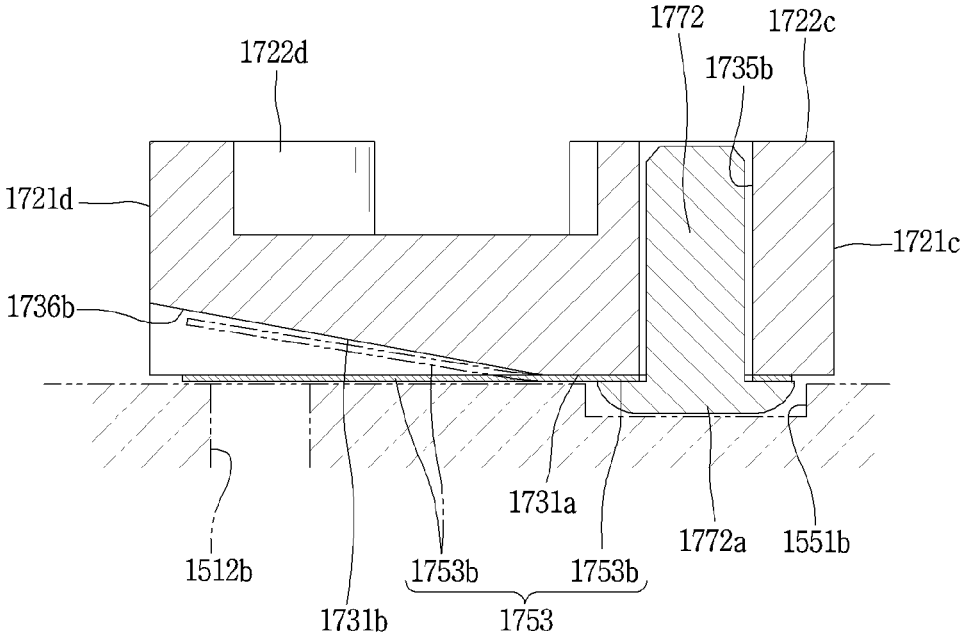

Meanwhile, referring to FIGS. 10 and 12B, the second valve support portion 1732 may include the second valve fixing surface 1732*a* and the second valve opening/closing surface 1732*b*. As described above, the second valve support portion 1732 may be disposed almost identically to the first valve support portion 1731. For example, the second valve opening/closing surface 1732*a* may be disposed to correspond to the first valve fixing surface 1731*a*, and the second valve opening/closing surface 1732*b* may be disposed to correspond to the first valve opening/closing surface 1731*b*. Accordingly, description about the second valve fixing surface 1732*a* and the second valve opening/closing surface 1732*b* will be replaced by the description about the first valve fixing surface 1731*a* and the first valve opening/closing surface 1731*b*.

However, the second valve fixing surface 1732*a* is disposed on a lower surface of the third radial fixing protrusion 1721*c*, and the second valve opening/closing surface 1732*b* may extend from the third radial fixing protrusion 1721*c* toward the fourth radial fixing protrusion 1721*d*. In other words, the second valve fixing surface 1732*a* may be disposed to be spaced apart from the first valve fixing surface 1731*a* by about 180° in the circumferential direction, and the second valve opening/closing surface 1732*b* may be disposed to be spaced apart from the first valve opening/closing surface 1731*b* by about 180° in the circumferential direction.

The second valve fixing surface 1732*a* may have a height and a shape identical or approximately identical to those of the first valve fixing surface 1731*a* and be connected thereto. For example, the second valve fixing surface 1732*a* may be disposed to be inversely-symmetrical to the first valve fixing surface 1731*a* with reference to a center of the block body 172, that is, a center Oh of the discharge guide hole 1742, and connected to the first valve fixing surface 1731*a*. Accordingly, the second valve fixing surface 1732*a* may define a block fixing surface 1725 constituting the first axial side surface 171*a* of the retainer block 171 (or block body) together with the first valve fixing surface 1731*a*.

In addition, as the second valve fixing surface 1732*a* is flat and connected to the first valve fixing surface 1731*a*, the first axial side surface 171*a* of the retainer block 171 (or block body) defines the block seating surface 1551 in contact with the block seating surface 1551 of the non-orbiting scroll 150 to have a comparatively large area. In other words, the block fixing surface 1725 may be disposed longitudinally along a first traverse direction connecting the first valve fastening hole 1735*a* to the second valve fastening hole 1735*b* discussed hereinafter, and have an approximately constant second transverse length (width) orthogonal to the first transverse direction (except for portions included in the first valve opening/closing surface 1731*b* and the second valve opening/closing surface 1732*b*). As a result, the retainer block 171 (or block body) may be widely supported and in close contact with respect to the block seating surface 1551 with a balance on both sides. Thus, the retainer block 171 (or block body) may be stably fixed to the non-orbiting scroll 150.

In addition, the discharge guide hole 1742 may be disposed through a center of the block fixing surface 1725 in the axial direction. For example, the second transverse length of the block fixing surface 1725 may be slightly greater than an inner diameter of the discharge guide hole 1742. Accordingly, a portion of the block fixing surface 1725 may be disposed along a periphery of the discharge guide hole 1742 to tightly seal the discharge port 1511. In addition, a valve connection portion 1754 of the bypass valve 1751, which will be described hereinafter, may be supported between the non-orbiting scroll 150 and the retainer block 171 (or block body) in the axial direction. The valve connection portion 1754 will be described hereinafter together with the bypass valve 1751.

The second valve fixing surface 1732*a* may be disposed to be symmetrical to the first valve fixing surface 1731*a* with reference to the first center line CL1 passing through the center Ob1 of the first bypass hole 1512*a* and the center Ob2 of the second bypass hole 1512*b*. The second valve opening/closing surface 1732*b* may be disposed to be inversely-symmetrical to the first valve opening/closing surface 1731*b* with reference to the second center line CL2 perpendicular to the first center line CL1 at the center Oh of the discharge guide hole 1742 discussed hereinafter. Accordingly, the second valve support portion 1732 may be disposed at a constant interval together with the first valve support portion 1731 along a clockwise (or counterclockwise) direction. By doing so, the first valve fastening hole 1735*a* may be located far apart from the first bypass hole 1512*a*, and accordingly, a great opening/closing length of the first bypass valve 1752 may be ensured.

In addition, the second valve fastening hole 1735*b* may axially extend through the second valve fixing surface 1732*a*, and the second discharge guide surface 1736*b* may be disposed on an end of the second valve opening/closing surface 1732*b*, that is, an opposite side of the second valve fixing surface 1732*a*. The second valve fastening hole 1735*b* may extend through the fourth block support surface 1726*d* discussed hereinafter, and the second discharge guide surface 1736*b* may extend toward the fourth discharge guide groove 1723*d*. Shapes and their resultant operational effects of the second valve fastening hole 1735*b* and the second discharge guide surface 1736*b*, thereof are almost identical to those of the first valve fastening hole 1735*a* and the first discharge guide surface 1736*a*. Thus, repetitive description thereof will not be provided here, and may be replaced by the description of the first valve fastening hole 1735*a* and the first discharge guide surface 1736*a*.

Referring to FIG. 11, the discharge valve accommodating portion 174 is disposed in an approximately central region of the block body 172. Accordingly, the discharge valve 1755 may be accommodated in the discharge valve accommodating portion 174 to open and close the discharge port 1511 located in the center of the non-orbiting end plate 151.

The discharge valve accommodating portion 174 may be recessed by a preset or predetermined depth into one side surface of the block body 172, or may be disposed through the block body 172. Accordingly, an opening/closing position of an opening/closing surface 1751*a* of the discharge valve 1755 may be determined depending on the shape of the discharge valve accommodating portion 174.

For example, when a central portion of the discharge valve accommodating portion 174 is recessed, the discharge valve 1755 is in contact with a bottom surface of the discharge valve accommodating portion 174 to define a valve seat surface, and when a central portion of the discharge valve accommodating portion 174 penetrates therethrough, the discharge valve 1755 is in contact with the rear surface 151*a* of the non-orbiting end plate 151 to define a valve seat surface. In this embodiment, an example is provided in which the discharge valve accommodating portion 174 is recessed from one side surface of the block body portion 172 toward the rear surface 151*a* of the non-orbiting end plate 151 by a preset or predetermined depth, for example, by a height of the axial fixing protrusions 1722.

The discharge valve accommodating portion 174 according to this embodiment includes the discharge valve seating surface 1741 and the discharge guide hole 1742. The discharge valve seating surface 1741 constitutes a bottom surface of the discharge valve accommodating portion 174, and the discharge guide hole 1742 constitutes a portion of a discharge passage opened or closed by a discharge valve. Accordingly, refrigerant discharged from the discharge port 1511 moves to the intermediate discharge port 1612*a* of the back pressure plate 161 via the discharge valve accommodating portion 174.

The discharge valve seating surface 1741 is recessed into the second axial side surface 171*b* of the retainer block 171 (or block body) facing the back pressure chamber assembly 160 by a preset or predetermined depth, for example, a height of the axial fixing protrusions 1722. Accordingly, the plurality of axial fixing protrusions 1722 spaced apart from each other along the circumferential direction on an edge of the second axial side surface 171*b* of the retainer block 171 (or block body) are connected to each other by the discharge valve seating surface 1741.

The discharge valve seating surface 1741 is wider than the opening/closing surface 1751*a* of the discharge valve 1755 so that the discharge valve 1755 is seated thereon. The discharge valve seating surface 1741 is flat such that the discharge guide hole 1742 discussed hereinafter is open and closed as the opening/closing surface 1751*a* of the discharge valve 1755 is brought into contact with or separated from the discharge valve seating surface 1741. Accordingly, when the discharge valve 1755 is closed, the opening/closing surface 1751*a* of the discharge valve 1755 is seated on the discharge valve seating surface 1741 to tightly close the discharge guide hole 1742 discussed hereinafter.

The discharge guide hole 1742 is axially disposed through the block fixing surface 1725 and the discharge valve seating surface 1741 each described above. In other words, the discharge guide hole 1742 may axially extend through a portion between the block fixing surface 1725 defining a lower surface of the block body 172 and the discharge valve seating surface 1741 defining a bottom surface of the discharge valve accommodating portion 174. Accordingly, the discharge port 1511 may communicate with the discharge valve accommodating portion 174 through the discharge guide hole 1742.

The discharge guide hole 1742 may be disposed on a same axial line as the discharge port 1511 or may be disposed to at least partially communicate with the discharge port 1511 even though it is disposed on a different axial line from the discharge port 1511. In other words, an inner diameter of the discharge guide hole 1742 may be larger than or equal to an inner diameter of the discharge port 1511 so that the discharge port 1511 is accommodated in the discharge guide hole 1742. Accordingly, refrigerant that has passed through the discharge port 1511 moves into the discharge valve accommodating portion 174 through the discharge guide hole 1742.

The axial fixing protrusions 1722 described above may be disposed on an edge of the discharge valve seating surface 1741 to have a height difference therebetween by a preset or predetermined height. For example, the first to fourth axial fixing protrusions 1722*a* to 1722*d* may be disposed on the edge of the discharge valve seating surface 1741 to be apart from each other with a space between each other in correspondence with the first to fourth discharge guide grooves 1723*a* to 1723*d* along the circumferential direction. Accordingly, the discharge valve seating surface 1741 may constitute substantial volume of the discharge valve accommodating portion 174 together with the first to fourth axial fixing protrusions 1722*a* to 1722*d* to communicate with the intermediate discharge port 1612*a* in the back pressure plate 161 through a space between the first to fourth axial fixing protrusions 1722*a* to 1722*d* without blockage.

Although not shown in the drawings, an inner circumferential surface of the discharge valve accommodating portion 174 may be disposed in multi-stages or may be inclined. For example, inner circumferential surfaces of the first to fourth axial fixing protrusions 1722*a* to 1722*d* constituting a side surface of the discharge valve seating surface 1741 may be disposed to have a height difference or be inclined. In these cases, even when the discharge valve accommodating portion 174 is disposed to have a great depth, stagnation of refrigerant due to a vortex near an inner circumferential surface of the first to fourth axial fixing protrusions 1722*a* to 1722*d* constituting an inner circumferential surface of the discharge valve accommodating portion 174 may be resolved. Accordingly, as the discharge valve accommodating portion 174 is disposed to have a great depth, a thickness of the discharge valve accommodating portion 174, for example, a length of the discharge guide hole 1742 may have a small length to further reduce dead volume in the discharge port 1511.

Referring back to FIGS. 2 to 4, the valve 175 according to this embodiment may include the bypass valve 1751 and the discharge valve 1755. A reed valve may be applied as the bypass valve 1751, and a piston valve may be applied as the discharge valve 1755. However, the embodiments are not limited thereto. In other words, the bypass valve 1751 may be a piston valve, and the discharge valve 1755 may be a reed valve. However, as described above, in this embodiment, an example in which a reed valve is applied as the bypass valve 1751 and a piston valve is applied as the discharge valve 1755 will be described.

Referring to FIGS. 8 to 12, the bypass valve 1751 may include the first bypass valve 1752, the second bypass valve 1753, and the valve connection portion 1754. In other words, the first bypass valve 1752 configured to open/close the first bypass hole 1512*a* and the second bypass valve 1753 configured to open/close the second bypass hole 1512*b* may be connected to each other by the valve connection portion 1754. In this case, assembly of the bypass valve 1751 may be easy, and assembly reliability may also improve. That is, even when the first bypass valve 1752 and the second bypass valve 1753 are fastened to each other with one valve fastening member, a same effect as that of fastening using two valve fastening members may be obtained. Accordingly, misalignment of positions of a plurality of bypass valves 1751 may be suppressed or prevented to easily and firmly assemble the bypass valves 1751.

However, the valve connection 1754 is not necessarily needed. For example, the first bypass valve 1752 and the second bypass valve 1753 may be separate from each other and provided independently. In this case, manufacture of the bypass valves 1751 may be easy and material loss may be reduced. That is, as the valve connection portion 1754 is not provided, the first bypass valve 1752 and the second bypass valve 1753 may be manufactured symmetrically to each other. Thus, the bypass valves 1751 may be easily manufactured, and a waste is not generated due to shape machining of the valve connection portion 1754 to thereby reduce material costs. Hereinafter, an example in which the first bypass valve 1752 and the second bypass valve 1753 are connected to each other will be described. An example in which the first bypass valve 1752 and the second bypass valve 1753 are separated from each other and provided independently will be described hereinafter with respect to another embodiment.

Referring to FIGS. 10 and 12, the first bypass valve 1752 may be disposed in parallel with the second bypass valve 1753. However, as described above, the first bypass valve 1752 and the second bypass valve 1753 may not be orthogonal to the first center CL1 connecting the center Od of the discharge port 1511 to the center Ob1 of the first bypass hole 1512*a* and the center Ob2 of the second bypass hole 1512*b* positioned at both sides of the center Od, but rather, may be inclined at a preset or predetermine angle, for example, about 45° relative to the first center line CL1. Accordingly, the first opening/closing portion 1752*b* and a second opening/closing portion 1753*b*, which will be described hereinafter, may be located at both sides of the discharge port 1511 on the first center line CL1, and the first fixing portion 1752*a* and the second fixing portion 1753*a* may be orthogonal to the first center line CL1 to be positioned at both sides of the discharge port 1511. Also, the valve connection portion 1754 may be disposed to be orthogonal to the first center line CL1 while surrounding the discharge port 1511. In this way, the first bypass valve 1752 and the second bypass valve 1753 may be disposed as far apart from the first bypass hole 1512*a* and the second bypass hole 1512*b* as possible without interfering with the discharge port 1511, and thus, suppress or prevent overcompression and/or collision noise.

The first bypass valve 1752 may include the first fixing portion 1752*a* and the first opening/closing portion 1752*b*. The first fixing portion 1752*a* is a portion constituting a fixed end of the first bypass valve 1752, and the first opening/closing portion 1752*b* is a portion constituting a free end of the first fixing portion 1752*a*. Accordingly, the first bypass valve 1752 constitutes a rectangular cantilever.

With respect to the first bypass valve 1752, a first elastic portion (no reference numeral) which is long and narrow may be disposed between the first fixing portion 1752*a* and the first opening/closing portion 1752*b*. However, the first elastic portion rotates relative to the first fixing portion 1752*a* together with the first opening/closing portion 1752*b*. Therefore, hereinafter, it may be understood that the first elastic portion is included in the first opening/closing portion 1752*b*. This is also applied to the second bypass valve 1753.

The first fixing portion 1752*a* is fixed in close contact between the retainer block 171 and the non-orbiting end plate 151. In other words, both side surfaces of the first fixing portion 1752*a* are fixed in close contact with the first valve fixing surface 1731*a* of the retainer block 171 and the block seating surface 1551 of the non-orbiting end plate 151, respectively. Accordingly, the retainer block 171 is fixed in close contact with the block insertion groove 155.

The first fixing portion 1752*a* may include a first valve through-hole 1752*c* through which the first valve fastening member (first rivet) 1771 is inserted. An inner diameter of the first valve through-hole 1752*c* may be smaller than an outer diameter of the head 1771*a* of the first valve fastening member 1771. Accordingly, the first fixing portion 1752*a* may be firmly fixed to the first valve fixing surface 1731*a* constituting the first axial side surface 171*a* of the retainer block 171 by the head 1771*a* of the first fastening member 1771 disposed therethrough from the non-orbiting scroll 150 toward the retainer block 171.

The first opening/closing portion 1752*b* extends from the first fixing portion 1752*a* to be bendable between the retainer block 171 and the non-orbiting end plate 151. In other words, one (first) end of the first opening/closing portion 1752*b* extends from the first fixing portion 1752*a* and the other (second) end is provided as a free end to constitute a cantilever. Accordingly, the first opening/closing portion 1752*b* is flexibly bent based on the first fixing portion 1752*a* in a space defined between the first valve opening/closing surface 1731*b* of the retainer block 171 and the block seating surface 1551 of the non-orbiting end plate 151 facing the first valve opening/closing surface 1731*b*.

A cross-sectional area of the first opening/closing portion 1752*b* may be wider than that of the first bypass hole 1512*a*. Accordingly, the first opening/closing portion 1752*b* opens and closes the first bypass hole 1512*a* while being flexibly bent based on the first fixing portion 1752*a* by pressure of the compression chamber V.

Referring to FIGS. 10 to 12, the second bypass valve 1753 may include the second guide portion 1753*a* and the second opening/closing portion 1753*b*. The second fixing portion 1753*a* is a portion constituting a fixed end of the second bypass valve 1753 and corresponds to the first fixing portion 1752*a*, and the second opening/closing portion 1753*b* is a portion constituting a free end of the second fixing portion 1753*a* and corresponds to the first opening/closing portion 1752*b*. Therefore, description of the second bypass valve 1753 will be understood by the description of the first bypass valve 1752.

For example, the second valve through-hole 1753*c* is disposed in the second fixing portion 1753*a*, and a cross-sectional area of the second opening/closing portion 1753*b* may be wider than that of the second bypass hole 1512*b*. Accordingly, the first fixing portion 1752*a* may be fixed to the second valve fixing surface 1732*a* of the retainer block 171 by the head 1772*a* of the second fastening member 1772, and the second opening/closing portion 1753*b* opens or closes the second bypass hole 1512*b* by being bent based on the second fixing portion 1753*a*.

However, the second fixing portion 1753*a* is disposed at an opposite side of the first fixing portion 1752*a* on the second center line CL2 with reference to the discharge port 1511, and the second opening/closing portion 1753*b* is disposed at an opposite side of the first opening/closing portion 1752*b* on the first center line CL1 with reference to the discharge port 1511. In other words, the bypass valves 1751 are disposed in an order from the first fixing portion 1752*a*, the first opening/closing portion 1752*b*, the second fixing portion 1753*a* to the second opening/closing portion 1753*b* along the circumferential direction. Accordingly, the first bypass valve 1752 including the first fixing portion 1752*a* and the first opening/closing portion 1752*b* and the second bypass valve 1753 including the second fixing portion 1753*a* and the second opening/closing portion 1753*b* may have a shape of an approximate square (or rhombus) when axially projected. In this way, as described above, the block insertion groove 155 may have a circular shape, and the first opening/closing portion 1752*b* and the second opening/closing portion 1753*b* may be disposed to have as great a length as possible to thereby suppress or prevent a delay in opening the bypass valves 1751.

Referring to FIGS. 8 to 10, the valve connection portion 1754 is a portion connecting the first bypass valve 1752 to the second bypass valve 1753. The valve connection portion 1754 connects the first fixing portion 1752*a* to the second fixing portion 1753*a*. The valve connection portion 1754 integrally extends from the first bypass valve 1752 and the second bypass valve 1753. Accordingly, the bypass valves 1751 may be easily assembled, and although the first bypass valve 1752 and the second bypass valve 1753 are fastened with one first valve fastening member 1771 and one first valve fastening member 1772, respectively, an effect of respectively fastening the first bypass valve 1752 and the second bypass valve 1753 with two first and second valve fastening members 1771 and 1772 may be obtained. Through this, when the bypass valves 1751 are fastened, misalignment due to distortion of the bypass valve 1751 may be suppressed or prevented.

The valve connection portion 1754 may include first connection portions 1754*a* and second connection portion 1754*b*. The first connection portions 1754*a* are portions extending respectively from the first fixing portion 1752*a* and the second fixing portion 1753*a*, respectively. The second connection portion 1754*b* is a portion connecting spaces between the first connection portions 1754*a*. Accordingly, a plurality of the first connection portions 1754*a* may be present, and a single second connection portion 1754*b* may be present.

The first connection portions 1754*a* may have a linear shape, and the second connection portion 1754*b* may have a circular shape. In other words, the first connection portions 1754*a* may be respectively disposed in a straight line along the second center line CL2, and the second connection portion 1754*b* may be disposed to connect ends of first connection portions 1754*a* at both sides in a circular shape. In other words, the first connection portions 1754*a* are connected to each other by the second connection portion 1754*b* surrounding the discharge guide hole 1742 of the block body portion 172 so that the valve connection portion 1754 is provided as a single body. Accordingly, even when the discharge guide hole 1742 is located between the first fixing portion 1752*a* and the second fixing portion 1753*a*, the discharge guide hole 1742 is not covered by the valve connection portion 1754, but may connect the first fixing portion 1752*a* to the second fixing portion 1753*a*.

In other words, a discharge communication hole 1754*c* is provided in the second connection portion 1754*b* to communicate with the discharge guide hole 1742. An inner diameter of the discharge communication hole 1754*c* is equal to or greater than that of the discharge guide hole 1742. Accordingly, the second connection portion 1754*b* does not interfere with the discharge guide hole 1742, and thus, refrigerant passing through the discharge guide hole 1742 may smoothly move toward the discharge valve accommodating portion 174 without being blocked by the second connection portion 1754*b*.

The discharge valve 1755 may be slidably inserted in the axial direction into the valve guide groove 1612*b* provided in the back pressure plate 161 to open and close the discharge guide hole 1742 described above. The discharge valve 1755 is always or periodically accommodated in the discharge valve accommodating portion 174. For example, when the discharge valve 1755 is longer than a depth of the discharge valve accommodating portion 174, the opening/closing surface 1751*a* of the discharge valve 1755 may be located inside of the discharge valve accommodating portion 174 not only when the discharge valve 1755 is closed but also when the discharge valve 1751 is open. On the other hand, when the discharge valve 1755 is shorter than the depth of the discharge valve accommodating portion 174, the opening/closing surface 1751*a* of the discharge valve 1755 may be located outside of the discharge valve accommodating portion 174 when the discharge valve 1755 is open. In the former case, the discharge valve 1755 may be quickly closed, whereas in the latter case, discharge resistance due to the discharge valve 1755 may be reduced.

The discharge valve 1755 may have a shape of a rod or cylinder. In other words, the discharge valve 1755 may have a solid cylindrical shape or a hollow cylindrical shape. The discharge valve 1755 of this embodiment may have a semi-circular rod or semi-cylindrical shape with an upper end closed and a lower end open. This may reduce a weight of the discharge valve 1755 and simultaneously prevent oil in the high-pressure portion 110*b*, which is a discharge space, from accumulating inside of the discharge valve 1755.

Although not illustrated, the discharge valve 1755 may alternatively have a semi-circular rod or semi-cylindrical shape with an upper end open and a lower end closed. In this case, the weight of the discharge valve 1755 may be reduced, and the opening/closing surface of the discharge valve 1755 may be close to the discharge port 1511, thereby decreasing a dead volume. However, in this case, an oil discharge hole (not illustrated) may be disposed near the opening/closing surface 1751*a* of the discharge valve 1755 to penetrate through between inner and outer circumferential surfaces of the discharge valve, thereby preventing stagnation of oil in the discharge valve 1755.

The retainer block 171 according to this embodiment may be axially pressed between the non-orbiting scroll 150 and the back pressure chamber assembly 160 to be fixed to the non-orbiting scroll 150. For example, the retainer block 171 may be pressed between the non-orbiting scroll 150 and the back pressure chamber assembly 160 by the gasket 180 or a separate elastic member (not shown) to be fixed to the non-orbiting scroll 150. In this embodiment, an example in which the retainer block 171 is fixed by being pressed by the gasket 180 is shown.

Figure 13:
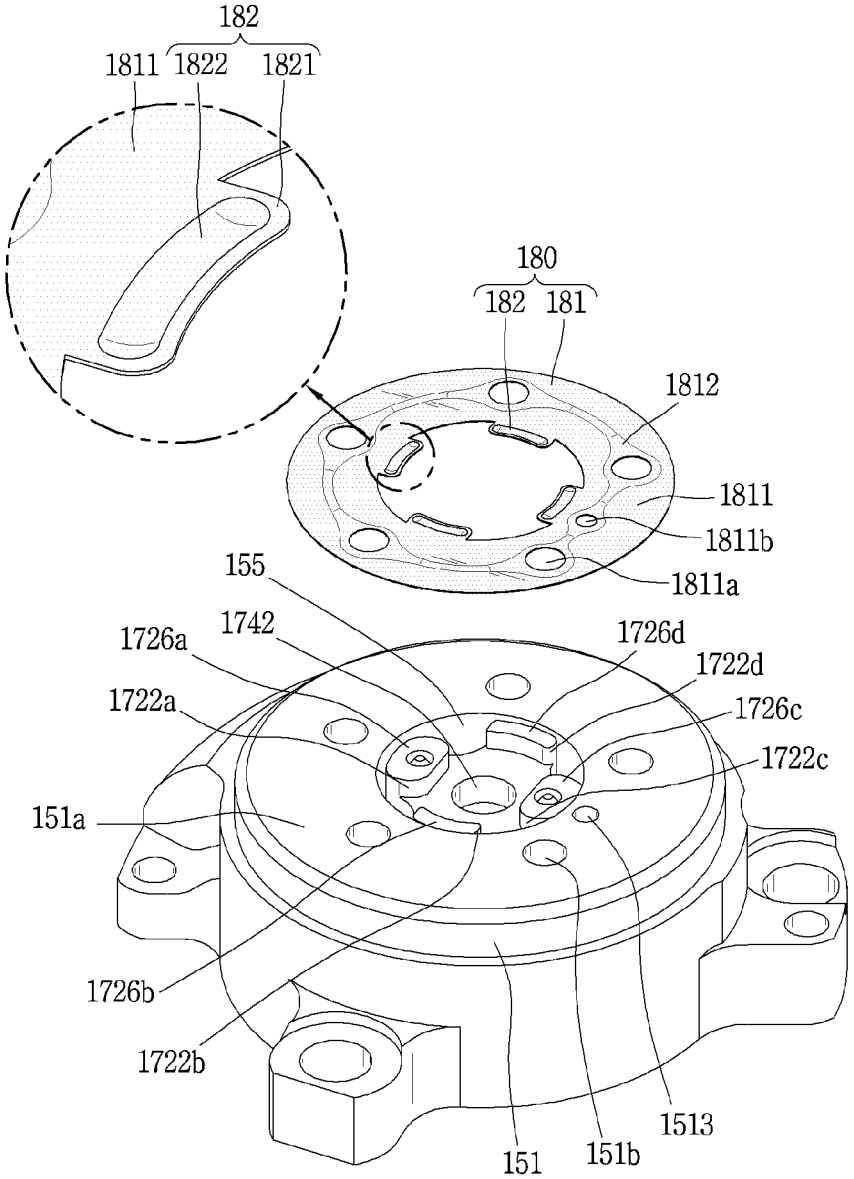
FIG. 13 is an exploded perspective view illustrating a gasket of FIG. 3.
Figure 14:
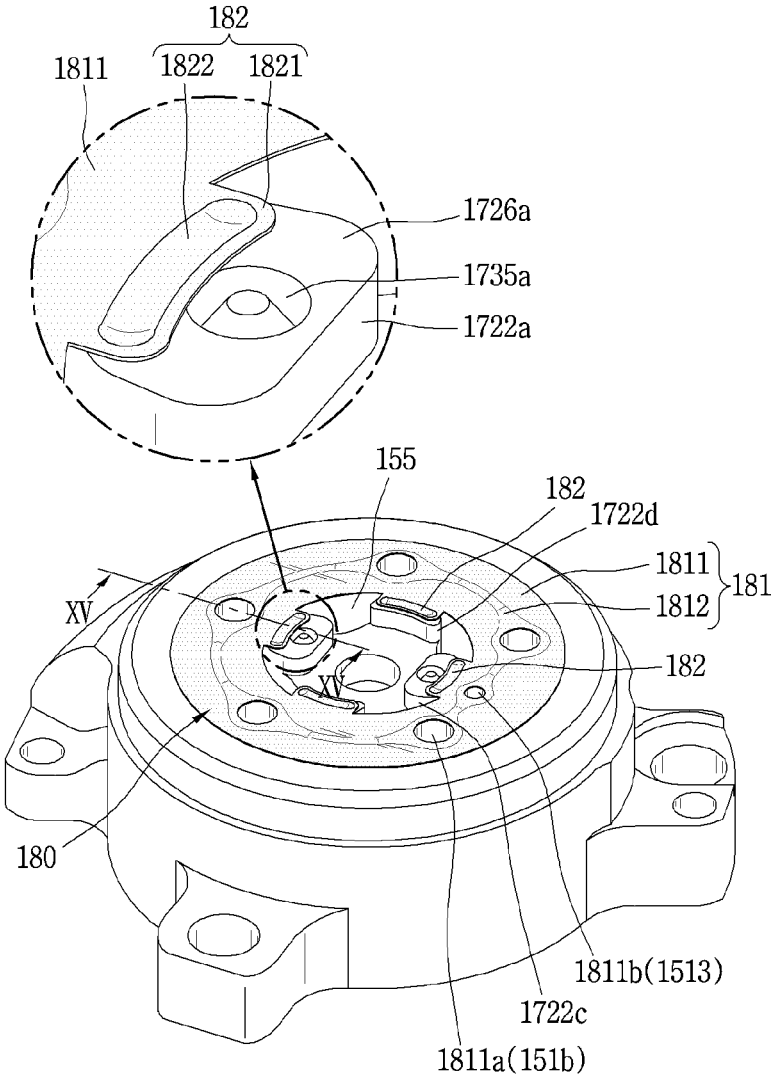
FIG. 14 is an assembled planar view of the gasket of FIG. 13.
Figure 15:
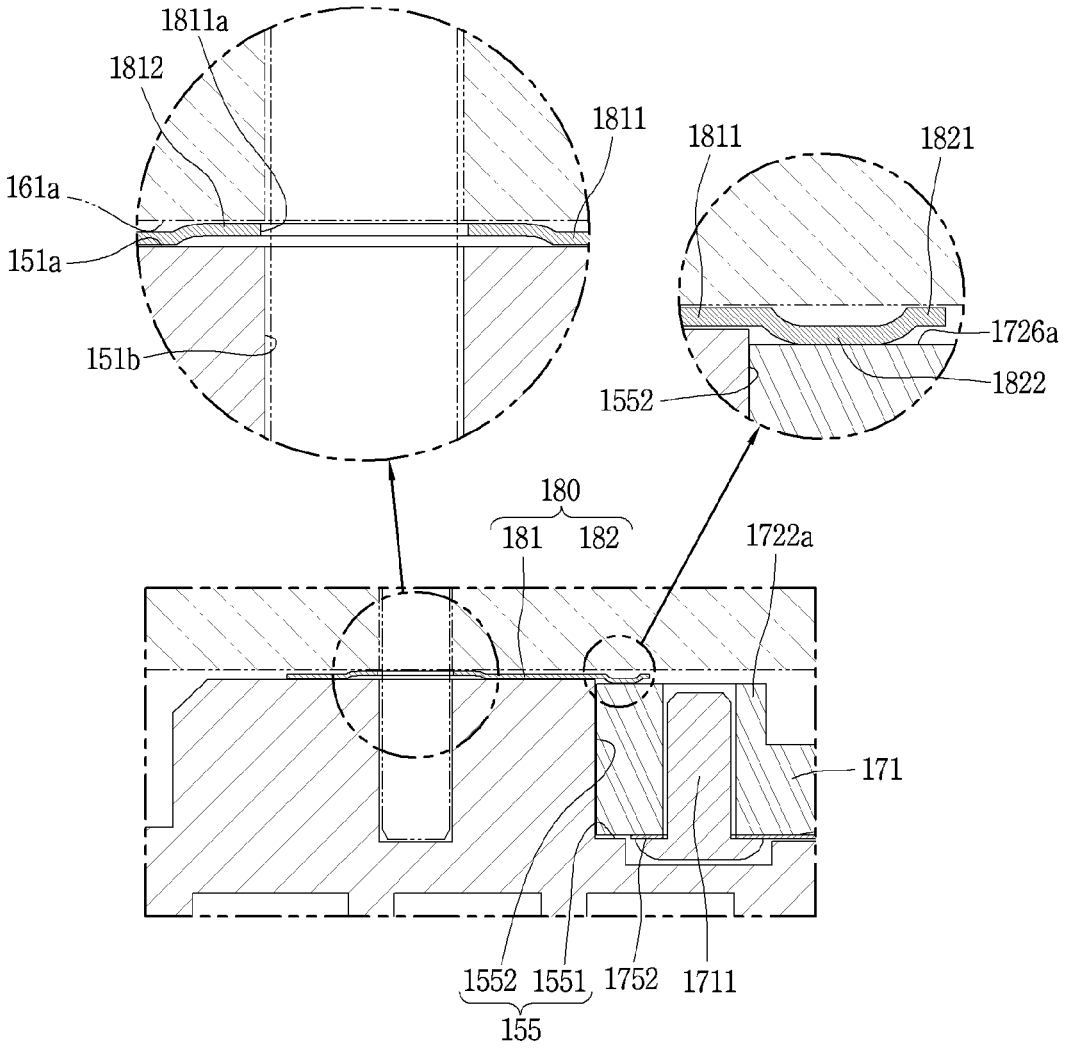
FIG. 15 is a cross-sectional view taken along a line "XV-XV" of FIG. 14.

Referring to FIGS. 13 to 15, the gasket 180 is a member for sealing between the non-orbiting scroll 150 and the back pressure chamber assembly 160. In this embodiment, a portion of the gasket 180 may extend in an axial direction of the retainer block 171. Accordingly, the gasket 180 or a portion of the gasket 180 may be understood as a block support member.

In general, the gasket 180 may be made of a single material, such as a non-metal material or a metal material, or by applying a non-metal material to a surface of a metal material. In this embodiment, the retainer block 171 is fixed using an elastic force of the gasket 180. Thus, the elastic force may be ensured when the gasket 180 is made of a metal material or by applying a non-metallic material to a surface of the metal material. Accordingly, the retainer block 171 may be stably fixed to the non-orbiting scroll 150 without a separate fixing member to reduce manufacture costs and simplify a manufacturing process.

The gasket 180 according to this embodiment may include a sealing portion 181 and block support portion 182. The sealing portion 181 is a portion that provides a seal between the non-orbiting scroll 150 and the back pressure chamber assembly 160. The block support portion 182 is a portion that presses the retainer block 171 toward the non-orbiting scroll 150 to support the retainer block 171 in the axial direction. The sealing portion 181 and the block support portion 182 may be a single body, or may be post-assembled. In this embodiment, an example in which the sealing portion 181 and the block support portion 182 are provided as a single body is shown. Accordingly, the gasket 180 that provides the seal between the non-orbiting scroll 150 and the back pressure chamber assembly 160, and at same time, fixes the retainer block 171 to the non-orbiting scroll 150 may be easily disposed.

The sealing portion 181 may include a sealing surface portion 1811 and a sealing bead 1812. The sealing surface portion 1811 is a portion disposed approximately in surface contact between the non-orbiting scroll 150 and the back pressure chamber assembly 160 to constitute a main body of the gasket 180. The sealing bead 1812 is a portion surrounding back pressure through holes 1811*a* and a back pressure connection hole 1811*b*, which will be described hereinafter, to thereby substantially seal the back pressure through holes 1811*a* and the back pressure connection hole 1811*b*.

Referring to FIGS. 13 and 14, the sealing surface portion 1811 may have an annular shape having a same thickness and width along the circumferential direction. For example, an outer diameter of the sealing surface portion 1811 may be equal to or smaller than an outer diameter of the non-orbiting end plate 151 and/or an outer diameter of the back pressure plate 161. In other words, the outer diameter of the sealing surface portion 1811 may be larger than a diameter of a virtual circle connecting the plurality of back pressure fastening grooves 151*b* in the rear surface 151*a* of the non-orbiting end plate 151 along the circumferential direction. Accordingly, the sealing surface portion 1811 may be concealed between the non-orbiting scroll 150 and the back pressure chamber assembly 160 not to be exposed to the outside, while tightly sealing a space between the non-orbiting scroll 150 and the back pressure chamber assembly 160.

In addition, an inner diameter of the sealing surface portion 1811, that is, inner diameter D4 of the sealing portion 181 may be equal to or greater than an inner diameter of the block insertion groove 155, that is, inner diameter D31 of the block accommodating surface 1552. In other words, the sealing surface portion 1811 may be configured such that the inner diameter D4 of the sealing surface portion 1811 is equal to or greater than the inner diameter of the block insertion groove 155, that is, the inner diameter D31 of the block accommodating surface 1552, and thus, an inner circumferential surface of the sealing surface portion 1811 may not further protrude toward the axial center O compared to an inner circumferential surface of the block insertion groove 155. Accordingly, refrigerant discharged through the bypass holes 1512 may smoothly move to the intermediate discharge port 1612*a* without being blocked by the sealing surface portion 1811 of the gasket 180.

In the sealing surface portion 1811, a plurality of the back pressure through holes 1811*a* may be disposed at a preset or predetermined interval along the circumferential direction. For example, the back pressure through holes 1811*a* may be disposed between the back pressure fastening grooves 151*b* and the back pressure fastening hole 1611*a* each described above, and on a same axis as that of the back pressure fastening hole 151*b* and the back pressure fastening hole 1611*a*. Accordingly, the back pressure fastening bolts 177 may penetrate through the sealing surface portion 1811 of the gasket 180 to firmly fasten the non-orbiting scroll 150 and the back pressure chamber assembly 160.

In addition, one back pressure connection hole 1811*b* may be disposed in the sealing surface portion 1811. The one back pressure connection hole 1811*b* may be located between the first back pressure hole 1513 and the second back pressure hole 1611*b*, each described above, and on a same axis as that of the first back pressure hole 1513 and the second back pressure hole 1611*b*. Accordingly, the refrigerant that has passed through the first back pressure hole 1513 may move to the back pressure chamber 160*a* through the back pressure connection hole 1811*b* and the second back pressure hole 1611*b*.

Referring to FIGS. 14 and 15, the sealing bead 1812 may be disposed on the sealing surface portion 1811 to axially protrude toward the rear surface 151*a* of the non-orbiting end plate 151 and/or the rear surface 161*a* of the back pressure plate 161 facing the rear surface 151*a* of the non-orbiting end plate 151. For example, the sealing bead 1812 may be disposed to surround peripheries of the back pressure through holes 1811*a* and the back pressure connection hole 1811*b*, and also protrude from the sealing surface 1811 toward the rear surface 161*a* of the back pressure plate 161. Accordingly, when the non-orbiting end plate 151 and the back pressure plate 161 are fastened with each other, the sealing bead 1812 may be pressed to be compressed by the rear surface 161*a* of the back pressure plate 161 to tightly seal the back pressure through holes 1811*a* and the back pressure connection hole 1811*b*.

Referring to FIGS. 13 to 15, the block support portion 182 may extend radially from an inner circumferential surface of the sealing portion 181 toward the axial center O. For example, the block support portion 182 may have an annular shape or an arcuate shape. However, when the block support portion 182 has an annular shape, the block support portion 182 may further protrude in the radial direction compared to an inner circumferential surface of the block insertion groove 155, and thus, may block spaces between the axial fixing protrusions 1722 of the block body 172. that is, the discharge guide grooves 1723. Then, the block support portion 182 constitutes a certain flow path barrier between the discharge guide grooves 1723 and the intermediate discharge port 1612*a* to prevent refrigerant discharged from the bypass holes 1512 from moving smoothly into the intermediate discharge port 1612*a*. Accordingly, in this embodiment, an example in which the block support portion 182 has an arcuate shape, more specifically, has a shape and/or located in a position which does not interfere with the discharge guide grooves 1723 is shown.

The block support portion 182 according to this embodiment may include a plurality of extension protrusions 1821 and a plurality of supporting protrusions 1822. Each of the extension protrusions 1821 is a portion constituting a main body of the block support portion 182, and each of the support protrusions 1822 is a portion that supports the retainer block 171 in the axial direction. Hereinafter, one extension protrusion among the plurality of extension protrusions 1821 and one support protrusion among the plurality of support protrusions 1822 will be described as representative examples.

Referring to FIGS. 14 and 15, the extension protrusion 1821 is disposed as a single body on an inner circumferential surface of the sealing surface portion 1811, and may extend radially toward the axial center O (or a center of a discharge port). For example, the extension protrusion 1821 may have an arcuate shape as described above, and may overlap the block support surfaces 1726*a* to 1726*d* of the axial fixing protrusions 1722 in the axial direction. Accordingly, the block body 172 of the retainer block 171 may be supported in a second axial direction toward the back pressure chamber assembly 160 by the extension protrusion 1821 of the block support portion 182.

The extension protrusion 1821 may be smaller than or equal to a cross-sectional area of the block support surfaces 1726*a* to 1726*d* of the axial fixing protrusions 1722. In other words, the extending protrusion 1821 may be positioned within a range of the block support surfaces 1726*a* to 1726*d* of the axial fixing protrusions 1722. Accordingly, the discharge guide grooves 1723 may be prevented from being concealed by the extension protrusion 1821.

Referring to FIG. 14, the support protrusion 1822 may protrude from an intermediate position of the extension protrusion 1821 by a predetermined height in the axial direction. Accordingly, the block body 172 of the retainer block 171 inserted into the block insertion groove 155 may be pressed toward the block seating surface 1551 by the support protrusion 1822 of the gasket 180 constituting a block support member (no reference numeral) to be tightly fixed to the block seating surface 1551 in the axial direction. Thus, a height of the block body 172 may be compensated in correspondence with an axial height of the support protrusion 1822. Accordingly, even when a height of the block body 172, that is, height H2 of a block support surface is slightly smaller than depth D1 of the block insertion groove 155, the block body 172 may be tightly fixed toward the block seating surface 1551.

Also, the support protrusion 1822 may protrude toward the retainer block 171 or the back pressure chamber assembly 160. In this embodiment, an example in which the support protrusion 1822 protrudes toward the second axial side surface 171*b* of the retainer block 171, that is, the block fixing surface 1725 of the axial fixing protrusions 1722 is shown. In other words, in this embodiment, an example in which the support protrusion 1822 protrudes in an opposite direction of the sealing bead 1812 described above is shown. Accordingly, even when an axial height of the support protrusion 1822 is not excessively high, a substantial height of the support protrusion 1822 may be increased to tightly fix the block body 172 toward the block seating surface 1551.

In addition, the support protrusion 1822 may have an embossed shape recessed from one side to another side of the extension protrusion 1821, as shown in FIG. 15. Accordingly, an elastic force of the support protrusion 1822 may be improved to actively correspond to a machining error between the block insertion groove 155 and the retainer block 171. However, the support protrusion 1822 is not limited to the embossed shape. For example, the extension protrusion 1821 may have a flat shape, and the support protrusion 1822 may protrude from a side surface facing the retainer block 171. In this case, a physical support force of the support protrusion 1822 may be improved.

In addition, the support protrusion 1822 may be disposed to have an arcuate shape elongated in the circumferential direction, as shown in FIG. 14. Accordingly, an area of the support protrusion 1822 may increase to stably support the retainer block 171. However, the support protrusion 1822 is not limited to the arcuate shape. For example, the support protrusion 1822 may have a circular cross-sectional shape, and a plurality of support protrusions 1822 may be disposed at a preset or predetermined interval along the circumferential direction. In this case, the plurality of discharge passage portions 1822 may be easily disposed.

Although not shown in the drawings, the block support member 182 described above with reference to the gasket 180 may not be included, and a separate block support member (not shown) may be disposed between the back pressure chamber assembly 160 and the retainer block 171. For example, the block support member may an elastic member, such as an O-ring, installed between the back pressure chamber assembly 160 and the retainer block 171, or an elastic member, such as a compression coil spring, installed between the back pressure chamber assembly 160 and the retainer block 171. In these cases, the elastic member may be fixedly inserted into a support member insertion groove (not shown) in a rear surface of the back pressure chamber assembly 160 (back pressure plate) or the block fixing surface 1725 of the retainer block 171 facing the rear surface of the back pressure chamber assembly 160. In these embodiments, the elastic member directly provides elastic force to the retainer block 171 by being compressed between the back pressure chamber assembly 160 and the retainer block 171 to thereby stably support the retainer block 171.

In the drawings, reference numeral 1756 denotes an elastic member that supports the discharge valve.

The scroll compressor according to an embodiment may operate as follows.

That is, when power is applied to the drive motor 120 and a rotational force is generated, the orbiting scroll 140 eccentrically coupled to the rotary shaft 125 performs an orbiting motion relative to the non-orbiting scroll 150 due to Oldham ring 139. At this time, first compression chamber V1 and second compression chamber V2 that continuously move are disposed between the orbiting scroll 140 and the non-orbiting scroll 150. Then, the first compression chamber V1 and the second compression chamber V2 are gradually reduced in volume moving from the suction port (or suction chamber) 1531 to the discharge port (or discharge chamber) 1511 during the orbiting motion of the orbiting scroll 140.

Refrigerant is suctioned into the low-pressure portion 110*a* of the casing 110 through the refrigerant suction pipe 117. Some of this refrigerant is suctioned directly into the suction pressure chambers (no reference numerals given) of the first compression chamber V1 and the second compression chamber V2, respectively, while the remaining refrigerant first flows toward the drive motor 120 to cool down the drive motor 120 and then is suctioned into the suction pressure chambers (no reference numerals given).

The refrigerant is compressed while moving along moving paths of the first compression chamber V1 and the second compression chamber V2. The compressed refrigerant partially flows into the back pressure chamber 160*a* defined by the back pressure plate 161 and the floating plate 165 through the first back pressure hole 1513 and the second back pressure hole 1611*b* before reaching the discharge port 1511. Accordingly, the back pressure chamber 160*a* forms an intermediate pressure.

Then, the floating plate 165 may rise toward the high/low pressure separation plate 115 to be brought into close contact with the sealing plate 1151 provided on the high/low pressure separation plate 115. The high-pressure portion 110*b* of the casing 110 may be separated from the low-pressure portion 110*a*, to prevent the refrigerant, discharged from each compression chamber V1 and V2 into the high-pressure portion 110*b*, from flowing back into the low-pressure portion 110*a*.

On the other hand, the back pressure plate 161 is pressed down toward the non-orbiting scroll 150 by the pressure of the back pressure chamber 160*a*. The non-orbiting scroll 150 is pressed toward the orbiting scroll 140. Accordingly, the non-orbiting scroll 150 may be brought into close contact with the orbiting scroll 140, thereby preventing the refrigerant inside of both compression chambers from leaking from a high-pressure compression chamber forming an intermediate pressure chamber to a low-pressure compression chamber.

The refrigerant is compressed to a set or predetermined pressure while moving from the intermediate pressure chamber toward the discharge pressure chamber. This refrigerant moves to the discharge port 1511 and the discharge guide hole 1742 communicating with the discharge port 1511 to press the discharge valve 1755 in an opening direction. Responsive to this, the discharge valve 1755 is pushed up along the valve guide groove 1612*b* by the pressure of the discharge pressure chamber, so as to open the discharge port 1511 and the discharge guide hole 1742. Then, the refrigerant in the discharge pressure chamber exhausts to the discharge valve accommodating portion 174 through the discharge port 1511 and the discharge guide hole 1742, and then flows toward the high-pressure portion through the intermediate discharge port 1612*a* provided in the back pressure plate 161.

The pressure of the refrigerant may rise above a preset or predetermined pressure due to various conditions occurring during operation of the compressor. Then, the refrigerant moving from the intermediate pressure chamber to the discharge pressure chamber may be partially bypassed in advance from the intermediate pressure chamber forming each compression chamber V1 and V2 toward the high-pressure portion 110*b* through the first bypass hole 1512*a* and the second bypass hole 1512*b* before reaching the discharge pressure chamber.

When the pressure in the first compression chamber V1 and the pressure in the second compression chamber V2 are higher than a set or predetermined pressure, the refrigerant compressed in the first compression chamber V1 moves to the first bypass hole 1512*a*, and the refrigerant in the second compression chamber V2 moves to the second bypass hole 1512*b*. Then, the refrigerant moving to these bypass holes 1512*a* and 1512*b* pushes up the first opening/closing portion 1752*b* of the first bypass valve 1752 and the second opening/closing portion 1753*b* of the second bypass valve 1753 that close the first bypass hole 1512*a* and the second bypass hole 1512*b*. The first opening/closing portion 1752*b* is bent with reference to the first fixing portion 1752*a* and the second opening/closing portion 1753*b* is bent with reference to the second fixing portion 1753*a* to open the first bypass hole 1512*a* and the second bypass hole 1512*b*. At this time, an open degree of the first opening/closing portion 1752*b* is limited by the first valve opening/closing surface 1731*b* of the retainer block 171, and an open degree of the second opening/closing portion 1753*b* is limited by the second valve opening/closing surface 1732*b* of the retainer block 171.

The refrigerant in the first compression chamber V1 and the refrigerant in the second compression chamber V2 exhaust through the first bypass hole 1512*a* and the second bypass hole 1512*b*, respectively. The refrigerant moves toward the discharge valve accommodating portion 174 through the discharge guide passage 170*a*, which is a space between the retainer block 171 and the block insertion groove 155. The refrigerant flows to the high-pressure portion 110*b* through the intermediate discharge port 1612*a* of the back pressure plate 161 together with the refrigerant discharged to the discharge valve accommodating portion 174 through the discharge guide hole 1742. Accordingly, the refrigerant compressed in the compression chamber V may be suppressed or prevented from being over compressed to a set or predetermined pressure or higher, thereby suppressing or preventing damage to the orbiting wrap 142 and/or the non-orbiting wrap 152 and improving compressor efficiency.

When overcompression of the compression chamber V is resolved and proper pressure is restored, the first opening/closing portion 1752*b* of the first bypass valve 1752 rotates with reference to the first fixing portion 1752*a*, and the second opening/closing portion 1753*b* of the second bypass valve 1753 rotates with reference to the second fixing portion 1753*a* to thereby be unfolded. Then, a process in which the first opening/closing portion 1752*b* blocks the first bypass hole 1512*a* and the second opening/closing portion 1753*b* blocks the second bypass hole 1512*b*, respectively, is repeated.

At this time, high-pressure refrigerant that has not yet been discharged is trapped in the first bypass hole 1512*a* and the second bypass hole 1512*b*. Then, as the pressure in the compression chamber V rises unnecessarily, the first bypass hole 1512*a* and the second bypass hole 1512*b* form a kind of dead volume. Therefore, it is advantageous in view of decreasing the dead volume to reduce the lengths of the first bypass hole 1512*a* and the second bypass hole 1512*a* by forming the non-orbiting end plate 151, having the first bypass hole 1512*a* and the second bypass hole 1512*b*, as thin as possible.

However, in the case where the bypass valve 1751 is fastened to the non-orbiting end plate 151 as in the related art, the minimum fastening thickness for fastening the bypass valve 1751 is required, and this has a limitation in reducing the thickness of the non-orbiting end plate 151. As described above, in this embodiment, the bypass valve 1751 is fastened to the valve assembly 170 that is disposed between the rear surface 151*a* of the non-orbiting end plate 151 and the rear surface 161*a* of the back pressure plate 161 facing the rear surface 151*a*. This may allow the non-orbiting end plate 151, in which the bypass holes 1512*a* and 1512*b* are disposed, to be as thin as possible. Accordingly, the dead volume in the first bypass hole 1512*a* and the second bypass hole 1512*b* may be minimized by minimizing the lengths L2 of the first bypass hole 1512*a* and the second bypass hole 1512*b*. Through this, an amount of refrigerant remaining in the first bypass hole 1512*a* and the second bypass hole 1512*b* may be minimized, thereby enhancing compression efficiency.

Further, in this embodiment, as the block insertion groove 155 into which the retainer block 171 is inserted has a circular shape, the non-orbiting scroll 150 including the block insertion groove 155 may be easily machined.

Furthermore, in this embodiment, as a plurality of bypass valves 1751 is inclined with respect to a virtual line connecting both bypass holes 1512, the block insertion groove 155 may be disposed in a circular shape while a sufficient opening/closing area for smooth opening/closing of both bypass valves 1751 may be ensured.

Hereinafter, description will be given of a valve assembly according to another embodiment.

That is, in the previous embodiment, a first bypass valve and a second bypass valve are connected to each other to be assembled. However, according to embodiments, the first bypass valve and the second bypass valve may be separate from each other and independently assembled.

Figure 16:
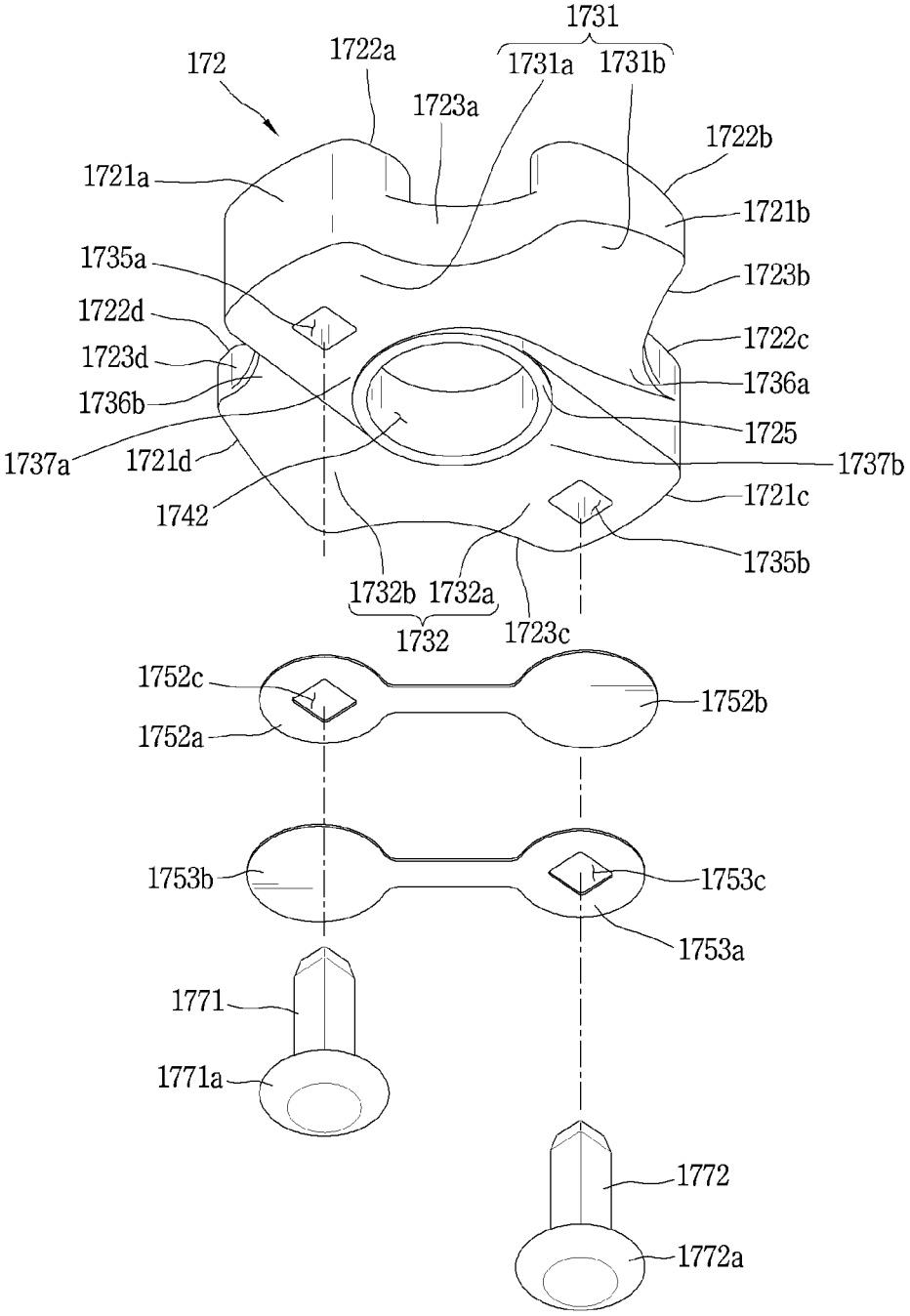
FIG. 16 is an exploded perspective view of another embodiment of the bypass valve of FIG. 8.
Figure 17:
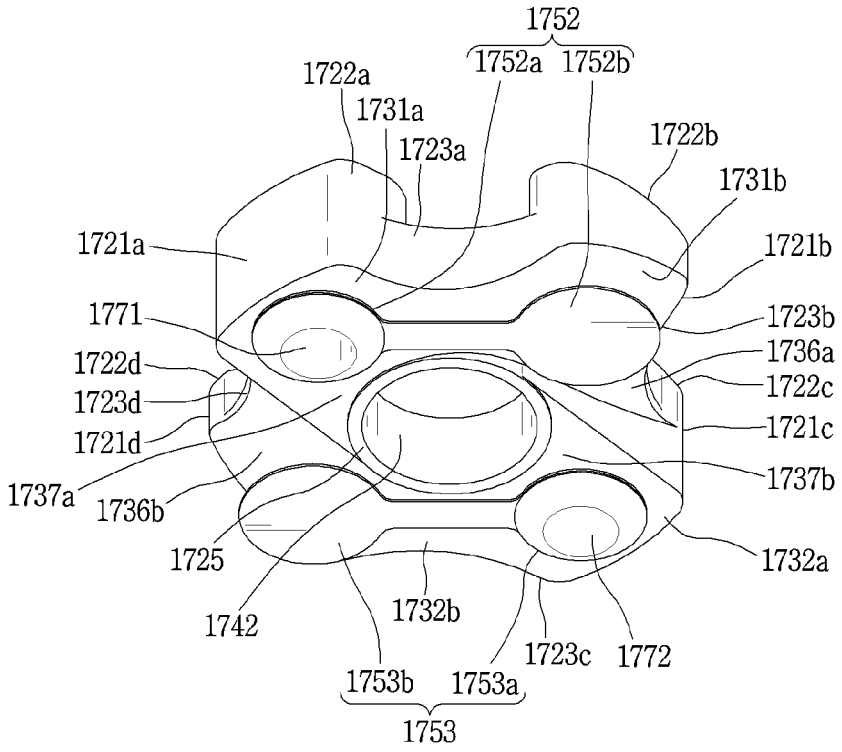
FIG. 17 is a perspective view illustrating an assembled state of the bypass valve of FIG. 16.
Figure 18:
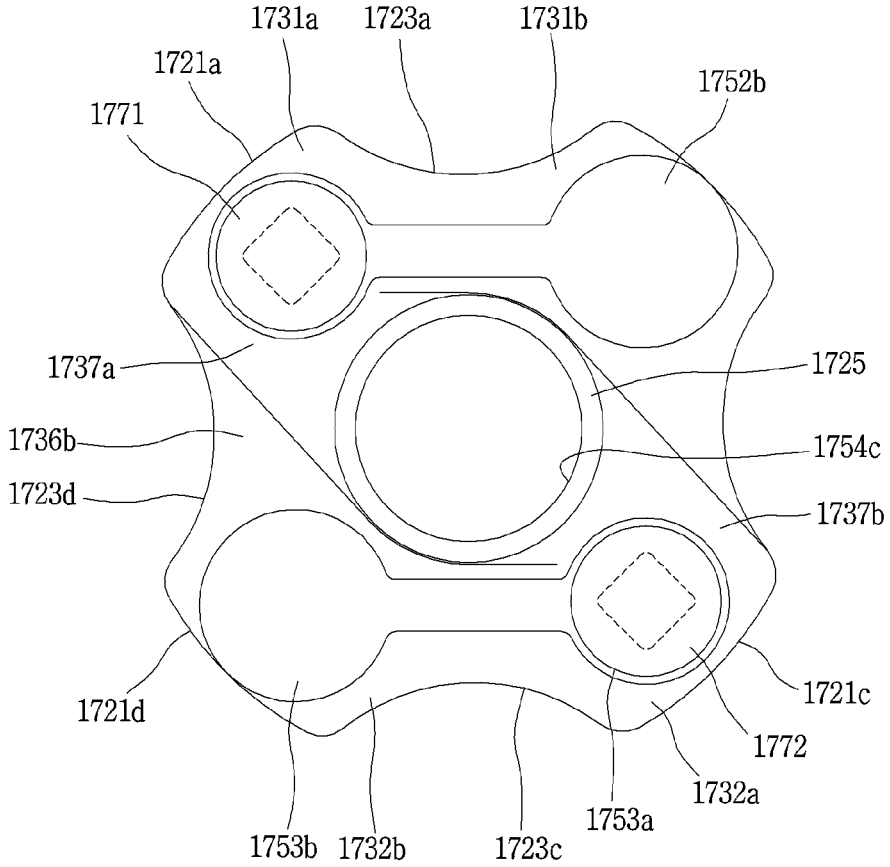
FIG. 18 is a bottom view of the assembled state of the bypass valve of FIG. 17.

Referring to FIGS. 16 to 18, the valve assembly 170 described above is disposed between the non-orbiting end plate 150 and the back pressure chamber assembly 160. Basic configurations of the non-orbiting scroll 150 and the back pressure assembly 160 with the valve assembly 170 and their operational effects are similar to those in the previous embodiment, and thus, repetitive description has been omitted.

For example, the block insertion groove 155 may be recessed by the preset or predetermined depth into the central portion of the rear surface 151*a* of the non-orbiting end plate 151, and the discharge port 1511 and the bypass holes 1512*a* and 1512*b* may be disposed through the non-orbiting end plate 151 inside of the block insertion groove 155. The valve assembly 170 may include the retainer block 171 and the valve 175, and the bypass valve 1751 constituting a portion of the valve 175 may be fastened to the retainer block 171. Accordingly, the lengths of the discharge port 1511 and the bypass holes 1512*a* and 1512*b* may be reduced by forming the non-orbiting end plate 151 to be thin. Through this, the dead volume in the discharge port 1511 and the bypass holes 1512*a* and 1512*b* may decrease.

In addition, the discharge valve accommodating portion 174 may be disposed in the retainer block 171, and the discharge valve accommodating portion 174 may be recessed in the axial direction into an upper surface of the retainer block 171 by a preset or predetermined depth like the embodiment of FIG. 2. Accordingly, a length of the discharge port 1511 may be reduced to reduce dead volume.

A basic configuration of the retainer block 171 according to this embodiment is similar to that in the previous embodiment. In other words, the retainer block 171 according to this embodiment may include the block body 172, the bypass valve support portion 173, and the discharge valve accommodating portion 174. The block body 172, the bypass valve support portion 173, and the discharge valve accommodating portion 174 may be disposed almost identically to those in the embodiment described above. Therefore, the basic configuration of the block body 172, the bypass valve support portion 173, and the discharge valve accommodating portion 174 may be replaced by the above-described embodiment.

The bypass valve 1751 may include the first bypass valve 1752 and the second bypass valve 1753. The first bypass valve 1752 may include the first fixing portion 1752*a* and the first opening/closing portion 1752*b*, and the second bypass valve 1753 may include the second fixing portion 1753*a* and the second opening/closing portion 1753*b*, respectively. The first bypass valve 1752 is configured to open/close the first bypass hole 1512*a*, and the second bypass valve 1753 is configured to open/close the second bypass hole 1512*b*. The first bypass valve 1752 and the second bypass valve 1753 are almost identical to the first bypass valve 1752 and the second bypass valve 1753 each described above. Therefore, detailed configurations and operations of the first bypass valve 1752 and the second bypass valve 1753 are replaced with those in the embodiment described above.

However, the first fixing portion 1752*a* of the first bypass valve 1752 and the second fixing portion 1753*a* of the second bypass valve 1753 according to this embodiment are separate from each other. In other words, in the bypass valve 1751 according to this embodiment, the valve connection portion 1754 connecting the first fixing portion 1752*a* to the second fixing portion 1753*a* is not included. Accordingly, the first fixing portion 1752*a* of the first bypass valve 1752 is fastened with the first valve fixing surface 1731*a*, and the second fixing portion 1753*a* of the second bypass valve 1753 is fastened with the valve fixing surface 1732*a*, respectively, independently.

In this case, the first valve seating groove 1737*a* may be disposed in the first valve fixing surface 1731*a* of the block body 172, and the second valve seating groove 1737*b* may be disposed in the second valve fixing surface 1732*a*. In other words, when the first bypass valve 1752 and the second bypass valve 1753 are separate from each other, the first axial side surface 171*a* of the retainer block 171 (or block body), that is, the block fixing surface 1725 may be located in a lower position compared to the first valve fixing surface 1731*a* and the second valve fixing surface 1732*a* in correspondence with a thickness of the first bypass valve 1752 and a thickness of the second bypass valve 1753. Then, as the block fixing surface 1725 is spaced apart from the block seating surface 1551, a certain leakage passage is generated between the discharge port 1511 and the discharge guide hole 1742. Thus, the discharge port 1511 may not be effectively opened or closed. Accordingly, the first valve seating groove 1737*a* may be disposed in the first valve fixing surface 1731*a* and the second valve seating groove 1737*b* may be disposed in the second valve fixing surface 1732*a* such that depths of the first valve seating groove 1737*a* and the second valve seating groove 1737*b* may be substantially identical to thicknesses of the first bypass valve 1752 and the second bypass valve 1753. While the valve connection portion 1754 is not disposed between the first bypass valve 1752 and the second bypass valve 1753, the first fixing portion 1752*a* of the first bypass valve 1752 and the second fixing portion 1753*a* of the second bypass valve 1753 have a same height as that of the block fixing surface 1725. Thus, generation of a leakage passage between the discharge port 1511 and the discharge guide hole 1742 may be suppressed or prevented.

Further, while the first valve through-hole 1752*c* is disposed in the first fixing portion 1752*a* of the first bypass valve 1752, and the second valve through hole 1753*c* is disposed in the second fixing portion 1753*a* of the second bypass valve 1753, the first valve through-hole 1752*c* and the second valve through hole 1753*c* may have an angular shape, for example, a rectangular cross-sectional shape. Furthermore, the first valve fastening hole 1735*a* and the second valve fastening hole 1735*b* in the block body 172 may have an angular shape, such as a rectangular cross-sectional shape, to correspond to the first valve through hole 1752*c* and the second valve through hole 1753*c*, respectively.

In addition, the first valve fastening member 1771 for fastening the first bypass valve 1752 and the second valve fastening member 1772 for fastening the second bypass valve 1753 may also have an angular shape, such as a rectangular cross-sectional shape, to correspond to the first valve fastening hole 1735*a* and the first valve through hole 1752*c*, and the second valve fastening hole 1735*b* and the second valve through hole 1753*c*, respectively. Thus, while one first bypass valve 1752 and one second bypass valve 1753 are fastened at one point by one valve fastening member 1771 and one valve fastening member 1772, respectively, reliability of fastening with respect to the bypass valves 1752 and 1753 may be improved.

As described above, when the first bypass valve 1752 and the second bypass valve 1753 are independently disposed, the first bypass valve 1752 and the second bypass valve 1753 may be easily manufactured. In addition, in a case of an integrated-type bypass valve as in the above-described embodiment, when the bypass valve 1751 is machined, parts or components other than the valve connection portion 1754 between the first bypass valve 1752 and the second bypass valve 1753 are wasted. Thus, material loss increases. However, like this embodiment, when the first bypass valve 1752 and the second bypass valve 1753 are independently machined, as the valve connection portion 1754 described above is not included, material loss may be reduced compared to the above-described embodiments.

The valve assembly according to embodiment disclosed herein may be equally applied to an open type as well as a hermetic type, to a high-pressure type as well as a low-pressure type, and even to a horizontal type as well as a vertical type. The embodiments disclosed herein may also be equally applied to an orbiting back pressure type or a tip seal type as well as the non-orbiting back pressure type. In particular, in the orbiting back pressure type or the tip seal type, a separate plate instead of back pressure chamber assembly 160 may be fixed to the rear surface of the non-orbiting scroll 150 (fixed scroll), and the valve assembly of the previous embodiments may be fixed using the plate. Even in this embodiment, the basic configuration of the valve assembly or the operational effect thereof may be substantially the same as those of the previous embodiments.

Embodiments disclosed herein provide a scroll compressor that is capable of suppressing overcompression and decreasing a dead volume in a compression chamber. Embodiments disclosed herein further provide a scroll compressor that is capable of reducing a length of a bypass hole and thus decreasing a dead volume in the bypass hole. Embodiments disclosed herein furthermore provide a scroll compressor that is capable of securing a fastening length for a bypass valve while reducing a length of a bypass hole.

Embodiments disclosed herein provide a scroll compressor that is capable of suppressing or preventing overcompression and decreasing dead volume in a compression chamber as well as simplifying a fastening structure of a bypass valve. Embodiments disclosed herein also provide a scroll compressor capable of increasing machinability by having a portion fixing a bypass valve in a circular shape. Embodiments disclosed herein additionally provide a scroll compressor in which a portion for fixing a bypass valve has a circular shape, and a plurality of bypass valves may ensure a sufficient opening/closing area.

Embodiments disclosed herein provide a scroll compressor in which a plurality of bypass valves may be easily and stably assembled.

Embodiments disclosed herein further provide a scroll compressor in which a plurality of bypass valves is modularized to enhance assembly and assembly reliability with respect to the plurality of bypass valves. Embodiments disclosed herein also provide a scroll compressor in which a plurality of bypass valves is modularized and refrigerant that passes through a bypass hole may be quickly discharged.

Embodiments disclosed herein provide a scroll compressor that may include a casing, an orbiting scroll, a non-orbiting scroll, and a back pressure chamber assembly. The casing may have an inner space, which may be divided into a low-pressure portion and a high-pressure portion. The orbiting scroll may be coupled to a rotary shaft in an internal space of the casing to perform an orbiting motion. The non-orbiting scroll may be engaged with the orbiting scroll to define a compression chamber, and may include a discharge port and a bypass hole through which refrigerant in the compression chamber is discharged. The back pressure chamber assembly may be coupled to a rear surface of the non-orbiting scroll to press the non-orbiting scroll toward the orbiting scroll. A block insertion groove may be disposed on the rear surface of the non-orbiting scroll to be recessed to a preset depth to accommodate the discharge port and the bypass hole therein. A retainer block including a bypass valve configured to open or close the bypass hole may be inserted into the block insertion groove. The bypass valves may include a first bypass valve configured to open or close a first bypass hole and a second bypass valve configured to open or close a second bypass hole and be disposed between the block insertion groove and the retainer block facing the block insertion groove. In this way, the bypass valve configured to suppress or prevent overcompression is not fastened with the non-orbiting end plate, and thus, the non-orbiting end plate may have a small thickness. Therefore, as a thickness of the non-orbiting end plate is small, a length of the bypass hole may be reduced, thereby decreasing dead volume in the bypass hole and enhancing compressor efficiency.

The block insertion groove may have a circumferential surface in a circular shape when projected in an axial direction. With this structure, the retainer block and the block insertion groove into which the retainer block is inserted may be easily machined so that manufacturing costs of the non-orbiting scroll and the retainer block may be reduced.

An intermediate discharge port configured to guide refrigerant discharged through the discharge port and the bypass hole to the high-pressure portion may be disposed in the back pressure chamber assembly. An inner diameter of the block insertion groove may be larger than a diameter of a first virtual circle connecting an inner circumferential surface of the intermediate discharge port. With this structure, while the block insertion groove has a circular cross-sectional shape, a discharge guide passage defined by an inner circumferential surface of the block insertion groove may smoothly communicate with the intermediate discharge port to quickly discharge refrigerant.

A plurality of bolt fastening grooves configured to fasten the back pressure chamber assembly may be disposed in the rear surface of the non-orbiting scroll by a preset or predetermined space or interval therebetween along a circumferential direction. The block insertion groove may be disposed on an inner side compared to a virtual circle connecting centers of the plurality of bolt fastening grooves. With this structure, a back pressure fastening groove may be located outside of the block insertion groove. Thus, even when a thickness of the non-orbiting end plate in the block insertion groove is small, the back pressure fastening groove may be disposed to have a great depth to thereby ensure fastening strength of a fastening bolt.

A depth of the block insertion groove may be equal to or greater than a length of the bypass hole. Thus, as the length of the bypass hole is reduced, dead volume in the bypass hole may be reduced, thereby improving compression efficiency.

A discharge guide passage may be defined between an inner circumferential surface of the block insertion groove and an outer circumferential surface of the retainer block to communicate with the bypass hole. Accordingly, even when the bypass valve is installed between the bypass hole and a lower surface of the retainer block, refrigerant discharged through the bypass hole may smoothly move to the intermediate discharge port located at an upper side of the retainer block.

A portion of the outer circumferential surface of the retainer block may be recessed to be spaced apart from the inner circumferential surface of the block insertion groove to define the discharge guide passage. With this structure, while the block insertion groove has a circular shape, a discharge guide passage may be smoothly defined between the inner circumferential surface of the block insertion groove and the outer circumferential surface of the retainer block.

The retainer block may include a block body; a bypass valve support portion disposed on one (first) side surface of the block body facing the non-orbiting scroll; and a discharge valve accommodating portion disposed on another (second) side surface of the block body facing the back pressure chamber assembly. The bypass valve support portion may include a first valve support portion configured to support the first bypass valve and a second valve support portion configured to support the second bypass valve. The first valve support portion and the second valve support portion may extend in opposite directions with reference to a first center line passing through the first bypass hole and the second bypass hole when projected in an axial direction. With this structure, the block insertion groove may be disposed in a circular shape, and a long opening/closing length of the bypass valve may be ensured. Thus, machining of the non-orbiting scroll including the block insertion groove may be facilitated and the bypass valve may be quickly opened or closed to thereby effectively suppress or prevent overpressure in the compression chamber.

The first valve support portion and the second valve support portion may be disposed to be inversely-symmetrical to each other with reference to the first center line when projected in an axial direction. By doing so, the first valve support portion and the second valve support portion may be ensured to have great support lengths, respectively, and respective bypass valves supported by the first and second valve support portions may be constantly opened or closed.

The first valve support portion may include a first valve fixing surface configured to fix the first bypass valve, and a first valve opening/closing surface extending from the first valve fixing surface to limit a degree of opening of the first bypass valve. The second valve support portion may include a second valve fixing surface configured to fix the second bypass valve, and a second valve opening/closing surface extending from the second valve fixing surface to limit a degree of opening of the second bypass valve. The first valve opening/closing surface and the second valve opening/closing surface may extend at an acute angle with respect to the first center line when projected in an axial direction. With this structure, the block insertion groove may have a circular shape, and the first bypass valve and the second bypass valve may be ensured to have a great opening/closing length as possible to thereby suppress or prevent overcompression and/or collision noise.

The block body may include a plurality of axial fixing protrusions spaced apart from each other by a preset or predetermined space therebetween in a circumferential direction to extend in a radial direction. The first valve fixing surface and the second valve fixing surface may be disposed on radial fixing protrusions located at positions at opposite positions, respectively, with reference to the discharge port when projected in the axial direction. With this structure, the first bypass valve and the second bypass valve may be positioned far apart from each other as possible to ensure the bypass valves to have as great an opening/closing length as possible.

A first valve fastening hole may be disposed in the first valve fixing surface to fix a first valve fastening member configured to fasten the first bypass valve. A second valve fastening hole may be disposed in the second valve fixing surface to fix a second valve fastening member configured to fasten the second bypass valve. The first valve fastening hole and the second valve fastening hole may be positioned on a second center line passing through the discharge port and being orthogonal to the first center line. With this structure, even when the block insertion groove has a circular shape, a fixing portion of the bypass valve may be located far apart from the bypass hole as possible to thereby ensure as great an opening/closing length of the bypass valves as possible.

For example, a first fastening member accommodating groove and a second fastening member accommodating groove may be disposed in a block seating surface of the block insertion groove facing each of the first valve fastening hole and the second valve fastening hole to accommodate a head of the first valve fastening member and a head of the second valve fastening member therein, respectively. The bypass valve may be applied as a reed valve, and the head of the fastening member that supports the bypass valve may be concealed. Thus, the non-orbiting end plate including the discharge port and/or the bypass hole may have a small thickness. Then, while a reed-type bypass valve may be applied, lengths of the discharge port and/or the bypass hole may be reduced, thereby decreasing dead volume in the discharge port and/or the bypass hole.

In addition, the first valve opening/closing surface and the second valve opening/closing surface may extend to radial fixing protrusions, respectively, neighboring other radial fixing protrusions on which the first valve fixing surface and the second valve fixing surface are disposed, respectively. By doing so, as a great length of the valve opening/closing surface as possible may be ensured, the bypass valve may be ensured to have a great opening/closing length.

With respect to the first valve opening/closing surface and the second valve opening/closing surface, a first discharge guide surface and a second discharge guide surface may be disposed at opposite ends of the first valve fixing surface and the second valve fixing surface, respectively. The first discharge guide surface and the second discharge guide surface may have large cross-sectional areas when positioned far apart from the first valve fixing surface and the second valve fixing surface. This may ensure a wide area between the bypass hole and the discharge guide passage, and thus, reduce flow resistance for refrigerant flowing from the bypass hole to the intermediate discharge port to quickly discharge refrigerant.

In addition, the block body may include a plurality of discharge guide grooves disposed to be recessed between the radial fixing protrusions in a radial direction and spaced apart from an inner circumferential surface of the block insertion groove. The plurality of discharge guide grooves may overlap the first valve opening/closing surface and the second valve opening/closing surface in a radial direction. With this structure, a great length of the valve opening/closing surface may be ensured, and the discharge guide groove defining the discharge guide passage may communicate with the valve opening/closing surface to allow refrigerant bypassed in the compression chamber to be quickly discharged.

Lengths of the plurality of discharge guide grooves may be equal to or greater than lengths of the plurality of radial fixing protrusions. With this structure, refrigerant bypassed in the compression chamber may be quickly discharged by ensuring a large cross-sectional area of the discharge guide passage as possible.

In addition, the block body may include a plurality of axial fixing protrusions spaced apart from each other by a preset or predetermined space therebetween in a circumferential direction and extending in an axial direction. The plurality of axial fixing protrusions may extend from the plurality of radial fixing protrusions toward the back pressure chamber assembly. With this structure, a discharge guide passage may be defined on a second axial side surface of the retainer block facing the back pressure chamber to quickly discharge refrigerant bypassed in the compression chamber.

Among the plurality of axial fixing protrusions, some axial fixing protrusions may be disposed through valve fastening holes configured to fasten the bypass valve, respectively. A cross-sectional area of each of other axial fixing protrusions which are not disposed through the valve fastening holes may be smaller than a cross-sectional area of each of the axial fixing protrusions which are disposed through the valve fastening holes. With this structure, a cross-sectional area of the discharge valve accommodating portion may be enlarged, and thus, discharge resistance in the discharge valve accommodating portion may be reduced. Therefore, refrigerant discharged through the discharge port and/or the bypass hole may quickly move toward a discharge space.

A block support surface may be disposed on each of the plurality of axial fixing protrusions. A height of the block support surface may be equal to or smaller than a depth of the block insertion groove with reference to the block seating surface of the block insertion groove. With this structure, the retainer block may be easily assembled between the non-orbiting scroll and the back pressure chamber assembly, and the non-orbiting scroll and the back pressure back pressure chamber assembly may be tightly sealed.

A block support member configured to support the retainer block toward the non-orbiting scroll may be disposed between the block support surface and the back pressure chamber assembly facing the block support surface. Thus, the retainer block may be tightly and stably fixed to the block insertion groove in the non-orbiting scroll.

The block insertion member may extend from a gasket positioned outside of the block insertion groove and configured to seal between the rear surface of the non-orbiting scroll and a rear surface of the back pressure chamber assembly facing the rear surface of the non-orbiting scroll. With this structure, the retainer block may be stably fixed to the non-orbiting scroll without a separate fixing member, thereby reducing manufacture costs and simplifying a manufacturing process.

The block support member may be made of an elastic member positioned inside of the block insertion groove and disposed on the block support surface or the back pressure chamber assembly facing the block support surface. Thus, the retainer block may be easily machined and stably fixed by ensuring a great tolerance for the retainer block.

As another example, the first bypass valve and the second bypass valve may be disposed in parallel with each other when projected in an axial direction to be opened or closed in opposite directions. With this structure, the first bypass valve and the second bypass valve may be ensured to have as great an opening/closing length as possible under a condition such that outer diameters of both bypass valves are same.

The first bypass valve and the second bypass valve may be connected to each other by a valve connection portion. With this structure, the first bypass valve and the second bypass valve may be easily and securely assembled by suppressing or preventing misalignment of positions of the first bypass valve and the second bypass valve.

The first bypass valve may include a first fixing portion fixed to the retainer block; and a first opening/closing portion extending from the first fixing portion to open or close the first bypass hole. The second bypass valve may include a second fixing portion fixed to the retainer block, and a second opening/closing portion extending from the second fixing portion to open or close the second bypass hole. The valve connection portion may be disposed to be inclined with respect to a second center line connecting the first fixing portion to the second fixing portion when projected in an axial direction. With this structure, the first fixing portion of the first bypass valve and the second fixing portion of the second bypass valve may be located as apart from each other as possible, and the first fixing portion and the second fixing portion may be stably connected to each other to easily and securely facilitate the first and second bypass valves.

The retainer block may be disposed through a discharge guide hole in an axial direction to communicate with the discharge port. The valve connection portion may include a plurality of first connection portions respectively extending from a first fixing portion of the first bypass valve and a second fixing portion of the second bypass valve, and a second connection portion extending from each of the plurality of first connection portions in a radial direction and disposed to have an annular shape to surround the discharge guide hole. With this structure, even when the discharge guide hole is disposed through a center of the retainer block, both bypass valves may be connected to each other, and leakage of refrigerant from a periphery of the discharge guide hole may be effectively suppressed.

In addition, the first bypass valve and the second bypass valve may be separate from each other and respectively fastened with the retainer block. With this structure, the first bypass valve and the second bypass valve may be manufactured symmetrically to each other. Thus, the bypass valve may be easily manufactured, and a portion of a base material to be wasted may be reduced to thereby reduce material costs.

The retainer block may include a first valve fixing surface configured to fix the first bypass valve and a second valve fixing surface configured to fix the second bypass valve, respectively. A first valve seating surface and a second valve seating surface may be disposed on the first valve fixing surface and the second valve fixing surface at lower positions in correspondence with thicknesses of the first bypass valve and the second bypass valve, respectively. With this structure, the first bypass valve and the second bypass valve may be assembled independently from each other, and refrigerant leakage that may occur around the discharge guide hole may be suppressed or prevented.

As another example, the retainer block may be fixed in close contact with a rear surface of the non-orbiting scroll and a rear surface of the back pressure chamber assembly facing the rear surface of the non-orbiting scroll by fastening force for fastening the non-orbiting scroll with the back pressure chamber assembly. With this structure, as the retainer block may be fixed without a separate fastening member, the assembly process for the retainer block may be simplified.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing divided into a low-pressure portion and a high-pressure portion;

an orbiting scroll coupled to a rotary shaft in an inner space of the casing to perform an orbiting motion;

a non-orbiting scroll engaged with the orbiting scroll to define a compression chamber, and provided with a discharge port and at least one bypass hole through which refrigerant in the compression chamber is discharged; and a back pressure chamber assembly coupled to a rear surface of the non-orbiting scroll to press the non-orbiting scroll toward the orbiting scroll, wherein a block insertion groove configured to accommodate the discharge port and the at least one bypass hole therein and recessed to a predetermined depth is disposed in a rear surface of a non-orbiting end plate of the non-orbiting scroll, wherein a retainer block comprising at least one bypass valve configured to open or close the at least one bypass hole is inserted into the block insertion groove, wherein the at least one bypass hole comprises a first bypass hole and a second bypass hole, wherein the at least one bypass valve comprises a first bypass valve configured to open or close the first bypass hole and a second bypass valve configured to open or close the second bypass hole, wherein the first and second bypass valves are disposed between the block insertion groove and the retainer block facing the block insertion groove, wherein a plurality of bolt fastening grooves configured to fasten the back pressure chamber assembly are disposed in the rear surface of the non-orbiting scroll at a predetermined interval along a circumferential direction, and wherein the block insertion groove is disposed on an inner side compared to a virtual circle that connects centers of the plurality of bolt fastening grooves.

2. The scroll compressor of claim 1, wherein the block insertion groove has a circumferential surface in a circular shape when projected in an axial direction, wherein at least one intermediate discharge port configured to guide refrigerant discharged through the discharge port and the first and second bypass holes to the high-pressure portion is disposed in the back pressure chamber assembly, and wherein an inner diameter of the block insertion groove is larger than a diameter of a first virtual circle corresponding to an inner circumferential surface of the at least one intermediate discharge port.

3. The scroll compressor of claim 1, wherein a depth of the block insertion groove is equal to or greater than a length of the first and second bypass holes, and wherein at least one discharge guide passage is defined between an inner circumferential surface of the block insertion groove and an outer circumferential surface of the retainer block to communicate with the first and second bypass holes.

4. The scroll compressor of claim 3, wherein a portion of the outer circumferential surface of the retainer block is recessed to be spaced apart from the inner circumferential surface of the block insertion groove to define the at least one discharge guide passage.

5. The scroll compressor of claim 1, wherein the retainer block comprises:

a block body;

a bypass valve support portion disposed at a first side surface of the block body facing the non-orbiting scroll; and a discharge valve accommodating portion disposed at a second side surface of the block body facing the back pressure chamber assembly, wherein the bypass valve support portion comprises a first valve support portion configured to support the first bypass valve and a second valve support portion configured to support the second bypass valve, and wherein the first valve support portion and the second valve support portion are disposed in opposite directions with reference to a first center line passing through the first bypass hole and the second bypass hole when projected in an axial direction.

6. The scroll compressor of claim 5, wherein the first valve support portion and the second valve support portion are disposed to be inversely-symmetrical to each other with reference to the first center line when projected in the axial direction.

7. The scroll compressor of claim 5, wherein the first valve support portion comprises:

a first valve fixing surface to which the first bypass valve is fixed; and a first valve opening/closing surface that extends from the first valve fixing surface to limit a degree of opening of the first bypass valve, wherein the second valve support portion comprises:

a second valve fixing surface to which the second bypass valve is fixed; and a second valve opening/closing surface that extends from the second valve fixing surface to limit a degree of opening of the second bypass valve, and wherein the first valve opening/closing surface and the second valve opening/closing surface each extend at an acute angle relative to the first center line when projected in the axial direction.

8. The scroll compressor of claim 7, wherein the block body comprises a plurality of radial fixing protrusions spaced apart from each other by a predetermined interval in a circumferential direction to extend in a radial direction, wherein the first valve fixing surface and the second valve fixing surface are disposed on radial fixing protrusions of the plurality of radial fixing protrusions located at opposite positions, respectively, with reference to the discharge port when projected in the axial direction, wherein a first valve fastening hole is disposed in the first valve fixing surface to fix a first valve fastening member configured to fasten the first bypass valve, and a second valve fastening hole is disposed in the second valve fixing surface to fix a second valve fastening member configured to fasten the second bypass valve, and wherein the first valve fastening hole and the second valve fastening hole are positioned on a second center line passing through the discharge port and orthogonal to the first center line.

9. The scroll compressor of claim 7, wherein the block body comprises a plurality of radial fixing protrusions spaced apart from each other by a predetermined interval in a circumferential direction to extend in the radial direction, wherein the first valve fixing surface and the second valve fixing surface are disposed on radial fixing protrusions of the plurality of radial fixing protrusions located at opposite positions, respectively, with reference to the discharge port when projected in the axial direction, wherein the first valve opening/closing surface and the second valve opening/closing surface extend to radial fixing protrusions of the plurality of radial fixing protrusions, respectively, neighboring other radial fixing protrusions on which the first valve fixing surface and the second valve fixing surface are disposed, respectively, wherein with respect to the first valve opening/closing surface and the second valve opening/closing surface, a first discharge guide surface and a second discharge surface are disposed at opposite ends of the first valve fixing surface and the second valve fixing surface, respectively, and wherein cross-sectional areas of the first discharge guide surface and the second discharge guide surface increase as the first discharge guide surface and the second discharge guide surface extend away from the first valve fixing surface and the second valve fixing surface, respectively.

10. The scroll compressor of claim 7, wherein the block body comprises a plurality of radial fixing protrusions spaced apart from each other by a predetermined interval in a circumferential direction to extend in a radial direction, wherein the first valve fixing surface and the second valve fixing surface are disposed on radial fixing protrusions of the plurality of radial fixing protrusions located at opposite positions, respectively, with reference to the discharge port when projected in the axial direction, wherein the block body comprises a plurality of discharge guide grooves recessed between the radial fixing protrusions in the radial direction and spaced apart from an inner circumferential surface of the block insertion groove, wherein the plurality of discharge guide grooves overlaps the first valve opening/closing surface and the second valve opening/closing surface in the radial direction, and wherein lengths of the plurality of discharge guide grooves are equal to or greater than lengths of the plurality of radial fixing protrusions.

11. The scroll compressor of claim 7, wherein the block body comprises a plurality of radial fixing protrusions spaced apart from each other by a predetermined interval in a circumferential direction to extend in a radial direction, wherein the first valve fixing surface and the second valve fixing surface are disposed on radial fixing protrusions of the plurality of radial fixing protrusions located at opposite positions, respectively, with reference to the discharge port when projected in the axial direction, wherein the block body comprises a plurality of axial fixing protrusions spaced apart from each other by a predetermined interval in the circumferential direction and extending in the axial direction, wherein the plurality of axial fixing protrusions extends from the plurality of radial fixing protrusions toward the back pressure chamber assembly, and wherein among the plurality of axial fixing protrusions, some axial fixing protrusions are disposed through valve fastening holes configured to fasten the first and second bypass valves, respectively, and a cross-sectional area of each of other axial fixing protrusions, which are not disposed through the valve fastening holes, is smaller than a cross-sectional area of each of the axial fixing protrusions which are disposed through the valve fastening holes.

12. The scroll compressor of claim 7, wherein the block body comprises a plurality of radial fixing protrusions spaced apart from each other by a predetermined interval in a circumferential direction to extend in a radial direction, wherein the first valve fixing surface and the second valve fixing surface are disposed on radial fixing protrusions of the plurality of radial fixing protrusions located at opposite positions, respectively, with reference to the discharge port when projected in the axial direction, wherein a block support surface is disposed on each of a plurality of axial fixing protrusions, and wherein a height of the block support surface is equal to or smaller than a depth of the block insertion groove with reference to a block seating surface of the block insertion groove.

13. The scroll compressor of claim 12, wherein a block support configured to support the retainer block toward the non-orbiting scroll is disposed between the block support surface and the back pressure chamber assembly facing the block support surface, and wherein the block support extends from a gasket positioned outside of the block insertion groove and configured to provide a seal between the rear surface of the non-orbiting scroll and a rear surface of the back pressure chamber assembly facing the rear surface of the non-orbiting scroll.

14. The scroll compressor of claim 12, wherein a block support configured to support the retainer block toward the non-orbiting scroll is disposed between the block support surface and the back pressure chamber assembly facing the block support surface, and wherein the block support is made of an elastic member positioned inside of the block insertion groove and disposed on the block support surface or the back pressure chamber assembly facing the block support surface.

15. The scroll compressor of claim 1, wherein the first bypass valve and the second bypass valve are disposed in parallel with each other when projected in an axial direction, and opened or closed in directions opposite to each other.

16. The scroll compressor of claim 15, wherein the first bypass valve and the second bypass valve are connected to each other by a valve connection portion, wherein the first bypass valve comprises:

a first fixing portion fixed to the retainer block; and a first opening/closing portion that extends from the first fixing portion to open or close the first bypass hole, wherein the second bypass valve comprises:

a second fixing portion fixed to the retainer block; and a second opening/closing portion that extends from the second fixing portion to open or close the second bypass hole, and wherein the valve connection portion is inclined with respect to a second center line that connects the first fixing portion to the second fixing portion when projected in the axial direction.

17. The scroll compressor of claim 16, wherein the retainer block includes a discharge guide hole that extends therethrough in the axial direction to communicate with the discharge port, and wherein the valve connection portion comprises:

a plurality of first connection portions that, respectively, extend from a first fixing portion of the first bypass valve and a second fixing portion of the second bypass valve; and and a second connection portion that extends from each of the plurality of first connection portions in a radial direction and disposed to have an annular shape to surround the discharge guide hole.

18. The scroll compressor of claim 15, wherein the first bypass valve and the second bypass valve are separate from each other and respectively fastened with the retainer block, wherein the retainer block comprises a first valve fixing surface configured to fix the first bypass valve and a second valve fixing surface configured to fix the second bypass valve, respectively, and wherein a first valve seating surface and a second valve seating surface are disposed on the first valve fixing surface and the second valve fixing surface at lower positions in correspondence with thicknesses of the first bypass valve and the second bypass valve, respectively.

19. The scroll compressor of claim 1, wherein the retainer block is fixed in contact with the rear surface of the non-orbiting scroll and a rear surface of the back pressure chamber assembly facing the rear surface of the non-orbiting scroll in an axial direction by a fastening force for fastening the non-orbiting scroll with the back pressure chamber assembly.

20. A scroll compressor, comprising:

a casing divided into a low-pressure portion and a high-pressure portion;

an orbiting scroll coupled to a rotary shaft in an inner space of the casing to perform an orbiting motion;

a non-orbiting scroll engaged with the orbiting scroll to define a compression chamber, and provided with a discharge port and at least one bypass hole through which refrigerant in the compression chamber is discharged; and a back pressure chamber assembly coupled to a rear surface of the non-orbiting scroll to press the non-orbiting scroll toward the orbiting scroll, wherein a block insertion groove configured to accommodate the discharge port and the at least one bypass hole therein and recessed to a predetermined depth is disposed in a rear surface of a non-orbiting end plate of the non-orbiting scroll, wherein a retainer block comprising at least one bypass valve configured to open or close the at least one bypass hole is inserted into the block insertion groove, wherein the at least one bypass hole comprises a first bypass hole and a second bypass hole, wherein the at least one bypass valve comprises a first bypass valve configured to open or close the first bypass hole and a second bypass valve configured to open or close the second bypass hole, wherein the first and second bypass valves are disposed between the block insertion groove and the retainer block facing the block insertion groove, and wherein a depth of the block insertion groove is equal to or greater than a length of the first and second bypass holes, and wherein at least one discharge guide passage is defined between an inner circumferential surface of the block insertion groove and an outer circumferential surface of the retainer block to communicate with the first and second bypass holes.

* * * * *